US007094476B2

(12) United States Patent
Kawashima et al.

(10) Patent No.: US 7,094,476 B2
(45) Date of Patent: Aug. 22, 2006

(54) SURFACE-TREATED PRODUCT, SURFACE-TREATMENT METHOD, AND SURFACE-TREATMENT APPARATUS

(75) Inventors: Shiro Kawashima, Shizuoka (JP); Hiromi Akihori, Ogasa-gun (JP); Matuo Suzuki, Ogasa-gun (JP); Hidekatu Hirahara, Ogasa-gun (JP); Aturo Yamamoto, Shuuchi-gun (JP); Katuya Kawamori, Yaizu (JP)

(73) Assignee: Asahi Tec Corporation, (JP)

( * ) Notice: Subject to any disclaimer, the term of this patent is extended or adjusted under 35 U.S.C. 154(b) by 403 days.

(21) Appl. No.: 10/606,282

(22) Filed: Jun. 26, 2003

(65) Prior Publication Data

US 2004/0050457 A1 Mar. 18, 2004

Related U.S. Application Data

(63) Continuation-in-part of application No. 10/270,181, filed on Oct. 15, 2002, now abandoned, which is a continuation-in-part of application No. 10/198,080, filed on Jul. 19, 2002, now abandoned.

(30) Foreign Application Priority Data

| | | |
|---|---|---|
| Jun. 27, 2002 | (JP) | 2002-187643 |
| Oct. 1, 2002 | (JP) | 2002-289208 |
| Apr. 18, 2003 | (JP) | 2003-113962 |
| Apr. 18, 2003 | (JP) | 2003-113966 |
| Apr. 25, 2003 | (JP) | 2003-121597 |
| May 12, 2003 | (JP) | 2003-132666 |

(51) Int. Cl.
*B23P 9/00* (2006.01)
*B21C 37/30* (2006.01)

(52) U.S. Cl. ..... 428/687; 428/577; 29/90.01; 29/90.7; 451/36; 451/38; 451/39; 451/40; 451/51; 451/59; 451/60; 451/61

(58) Field of Classification Search ..... 428/687, 428/577; 29/90.01, 90.7; 451/36, 38, 39, 451/40, 51, 59, 60, 61, 75, 76, 80, 89, 364, 451/365, 366, 914
See application file for complete search history.

(56) References Cited

U.S. PATENT DOCUMENTS

| | | | | |
|---|---|---|---|---|
| 2,777,256 | A * | 1/1957 | Paasche | 451/89 |
| 4,797,327 | A * | 1/1989 | Honda et al. | 428/687 |
| 5,300,259 | A | 4/1994 | Tashiro | 261/44.3 |

FOREIGN PATENT DOCUMENTS

| | | |
|---|---|---|
| EP | 1 065 345 A2 | 1/2001 |
| JP | 59-64267 | 4/1984 |

(Continued)

OTHER PUBLICATIONS

Japan Patent Office PCT Search Report for PCT/JP03/08148; Oct. 2003; 4 sheets.

(Continued)

*Primary Examiner*—Robert R. Koehler
(74) *Attorney, Agent, or Firm*—Steptoe & Johnson LLP

(57) ABSTRACT

There is provided a surface treated product that moves relatively in a fluid, wherein a surface of the surface treated product has continuous dimples, each dimple having a diameter of 10 to 2500 μm and a depth of 50 μm or less. The surface treated product significantly reduces resistance of a fluid to an object in the fluid, and significantly improves a flow state of the fluid.

16 Claims, 17 Drawing Sheets
(3 of 17 Drawing Sheet(s) Filed in Color)

SMOOTHED PRODUCT SURFACE ×10

FOREIGN PATENT DOCUMENTS

| | | |
|---|---|---|
| JP | 2-136559 | 5/1990 |
| JP | 4-256569 | 9/1992 |
| JP | 5-149132 | 6/1993 |
| JP | 5-149204 | 6/1993 |
| JP | 5-195892 | 8/1993 |
| JP | 8-246163 | 9/1996 |
| JP | 8-247343 | 9/1996 |
| JP | 10-028314 | 1/1998 |
| JP | 10-138117 | 5/1998 |
| JP | 11-190471 | 7/1999 |
| JP | 11-304300 | 11/1999 |
| JP | 2000-055014 | 2/2000 |

OTHER PUBLICATIONS

Japan Patent Office PCT Examination Report (Form 408) for PCT/JP03/08148; Jan. 2004; 6 sheets.

* cited by examiner

SMOOTHED PRODUCT SURFACE ×10

SMOOTHED PRODUCT SECTION ×10

CONVENTIONAL PRODUCT SURFACE ×10

CONVENTIONAL PRODUCT SECTION ×10

SMOOTHED PRODUCT SURFACE ×20

SMOOTHED PRODUCT SECTION ×20

CONVENTIONAL PRODUCT SURFACE ×20

CONVENTIONAL PRODUCT SECTION ×20

SMOOTHED PRODUCT SURFACE ×50

SMOOTHED PRODUCT SECTION ×50

CONVENTIONAL PRODUCT SURFACE ×50

CONVENTIONAL PRODUCT SECTION ×50

SURFACE-TREATED PRODUCT, SURFACE-TREATMENT METHOD, AND SURFACE-TREATMENT APPARATUS

CROSS-REFERENCE TO RELATED APPLICATION

This application is a continuation in part of U.S. patent application Ser. No. 10/270,181 filed on Oct. 15, 2002 now abandoned, which is a continuation in part of U.S. patent application Ser. No. 10/198,080 filed on Jul. 19, 2002 now abandoned.

BACKGROUND OF THE INVENTION AND RELATED ART STATEMENT

The present invention relates to a surface treated product that moves relatively in a fluid.

A technique of improving a flow state of a fluid is known such as providing dimples on a surface of an object on which a fluid flows to reduce resistance of the fluid. It is well known that a golf ball with dimples provides a long carry, and such a technique is disclosed in several patent documents.

For example, Japanese Patent Laid-Open No. 11-304300 (Patent document 1) proposes an efficient and noiseless refrigeration cycle in which a plurality of dimples are formed on a surface of a part through which a coolant passes. Japanese Patent Laid-Open No. 8-247343 (Patent document 2) discloses a heat exchanger tube in which many dimples are provided on an inner peripheral surface to improve heat transfer efficiency. Japanese Patent Laid-Open No. 10-28314 (Patent document 3) discloses a pipe type jumper apparatus in which dimples are formed on a surface to reduce air resistance and reduce rolling caused by wind pressure loads. Further, Japanese Patent Laid-Open No. 11-190471 (Patent document 6) proposes a pipe with low pipe line resistance in which pipe line resistance is reduced for use as a horizontal pipe line, and Japanese Patent Laid-Open No. 2000-55014 (Patent document 7) proposes a fluid resistance reducing apparatus in which dimples are arranged orderly to significantly reduce fluid resistance.

The applicant of the present invention proposes an intake pipe for an engine in which a wall surface of an intake passage is uneven with many small protrusions and recesses in Japanese Patent Laid-Open No. 5-149204 (Patent document 4), and proposes an exhaust pipe for an engine in which a wall surface of an exhaust passage is uneven with many small protrusions and recesses in Japanese Patent Laid-Open No. 5-149132 (Patent document 5), and achieves certain advantages.

SUMMARY OF THE INVENTION

The present invention has the same object as the above described related art to achieve an advantage of reducing resistance of a fluid etc., and the present invention is made to achieve further advantages. In the above described related art, dimples or an uneven surface are formed by pressing or casting to improve a flow state of a fluid on a surface of an object on which a fluid flows, while the present invention has been made by studies considering that the need for improving a flow state of a fluid on a surface of an object on which a fluid flows is simply directed to a flow state of a fluid on an extreme surface, and specific conditions of dimples or an uneven surface recesses on the surface should be determined along with smoothness of the surface.

Specifically, the present invention provides three surface treated products described below.

A first surface treated product according to the present invention is a surface treated product that moves relatively in a fluid, characterized in that a surface of the surface treated product has continuous dimples, each dimple having a diameter of 10 to 2500 μm and a depth of 50 μm or less.

A second surface treated product according to the present invention is a surface treated product that moves relatively in a fluid, characterized in that a surface of the surface treated product has continuous dimples, each dimple having a diameter of 10 to 2500 μm and a depth of 50 μm or less, and the surface has surface roughness Ra of 10 μm or less.

The first and the second surface treated products preferably have dimples of indefinite shape.

More specifically, the first and the second surface treated products are preferably castings molded by casting The first and the second surface treated products each have a hollow portion formed by a wall portion, and the surface having the above described features is preferably a surface of the wall portion defining the hollow portion.

A third surface treated product according to the present invention is a surface treated product that moves relatively in a fluid, characterized in that the surface treated product is a casting molded by casting and has a hollow portion formed by a wall portion, and a surface of the wall portion defining the hollow portion has surface roughness Ra of 10 μm or less.

The first, the second, and the third surface treated products are preferably made of cast iron or a light alloy for casting as a principal material.

According to the present invention, as the first, the second, and the third surface treated products made of cast iron or a light alloy for casting as a principal material, there is provided any one part selected from an automotive air intake system parts group consisting of an intake manifold, turbine housing, compressor cover, cylinder head, and air duct.

According to the present invention, there is provided a surface treatment method for treating a surface of a surface treated product that moves relatively in a fluid, characterized in that the surface treatment material containing at least a polyhedral or spherical material having a diameter of 5 mm or more is caused to collide with the surface.

In the surface treatment method according to the present invention, the surface treatment material is preferably made of two or more types of materials. Further, a collision is preferably caused by oscillation of either or both of the surface treated product and the surface treatment material.

In the surface treatment method according to the present invention, when the surface treated product has a hollow portion formed by a wall portion, and a surface to be treated of the surface treated product is a surface of the wall portion defining the hollow portion, the surface treatment material can be put in the hollow portion to oscillate the surface treated product and cause a collision. At this time, a percentage by volume of the surface treatment material put in the hollow portion to the hollow portion is preferably about 5% to 70%.

In the surface treatment method according to the present invention, when the surface treated product has hollow portion defined by the wall portion, and the surface to be treated of the surface treated product is the surface of the wall portion defining the hollow portion, a frequency of the oscillation is preferably about 5 to 20 Hz. A stroke of the oscillation is preferably about 30 to 200 mm. Further, the total oscillation time of the oscillation is preferably about 3 to 120 minutes.

In the surface treatment method according to the present invention, a principal material forming the surface treated product is preferably cast iron or a light alloy for casting. In this case, at least a part of the surface treatment material is preferably made of a metal material.

Further, according to the present invention, there is provided a surface treatment apparatus for artificially treating a surface of an object, including: fixing means for fixing the object in which a surface treatment material is put in an enclosed space having the surface as a forming surface in an arbitrary direction; and oscillating means for oscillating the fixing means. At this time, the oscillating means preferably has a prime mover and a crank connected to the prime mover.

Further, according to the present invention, there is provided a manufacturing method of a hollow casting, in which a casting having a hollow portion formed by a wall portion is manufactured, characterized in that after molten metal is poured into a mold to be molded by casting, processing of removing residual matters on a surface of the wall portion defining the hollow portion and processing of smoothing the surface of the wall portion defining the hollow portion are performed simultaneously.

The manufacturing method of a hollow casting according to the present invention preferably includes a process in which after the molding by casting, a smoothing material is put in hollow portion defined by the wall portion and the casting is oscillated. In other words, the processing of removing the residual matters and the processing of smoothing the surface of the wall portion defining the hollow portion are realized by putting the smoothing material in the hollow portion and the casting is oscillated.

In the manufacturing method of a hollow casting according to the present invention, cast iron or a light alloy for casting is preferably used as a principal material of the molten metal.

According to the present invention, there is provided any one part selected from an automotive air intake system parts group consisting of an intake manifold, turbine housing, compressor cover, cylinder head, and air duct, manufactured by the manufacturing method of a hollow casting.

Further, according to the invention, there is provided a sand removing method of a hollow casting, in which sand is removed from a surface of a casting having a hollow portion formed by a wall portion, characterized in that a shock application material is put in the hollow portion and the casting is oscillated. The sand removing method of a hollow casting according to the invention is useful in the case where the surface of the casting from which sand is removed is a surface of the wall portion defining the hollow portion from which sand cannot be conventionally easily removed.

In the sand removing method of a hollow casting according to the present invention, the hollow portion in which the shock application material is put may be a part or all of hollow portions of the casting. Specifically, according to the sand removing method of a hollow casting, the shock application material is oscillated in the hollow portion in which the shock application material is put, and the shock application material collides with the wall portion defining the hollow portion to cause a shock, thus allowing removal of sand in the hollow portion in which no shock application material is put.

In the sand removing method of a hollow casting according to the present invention, the hollow portion in which the shock application material is put is not limited, but for example, if the shock application material is put in a hollow portion having a large space or a hollow portion having a large diameter, in a casting having a plurality of hollow portions with various sizes or diameters, oscillation of the shock application material tends to cause a shock more effectively. In this case, the object of removing sand from a hollow portion having a smaller space or a hollow portion having a smaller diameter can be achieved too without putting the shock application material in such a hollow portion.

In the sand removing method of a hollow casting according to the present invention, when the casting from which sand is removed is an automotive air intake system part having a cooling water channel as a part of hollow portions, the shock application material is preferably put in hollow portions other than the cooling water channel. This also facilitates removal of sand in the cooling water channel. As an automotive air intake system part having a cooling water channel as a part of hollow portions, a cylinder head, an intake manifold, an exhaust manifold, etc. are cited. In the case of a cylinder head, an intake port and an exhaust port correspond to the hollow portions other than the cooling water channel.

In the sand removing method of a hollow portion according to the present invention, a frequency of oscillation is preferably about 5 to 20 Hz, and a stroke of the oscillation is preferably about 30 to 200 mm. Further, the total oscillation time of the oscillation is preferably about 1 to 120 minutes.

In the sand removing method of a hollow portion according to the present invention, the shock application material is preferably constituted by metal balls having a diameter of about 3 to 30 mm, and may contain metal balls having the same diameter or a mixture of metal balls having different diameters.

The sand removing method of a hollow portion according to the present invention is suitable for the case where a principal material forming the casting is cast iron or an aluminum alloy for casting.

Further, according to the present invention, there are provided two oscillating apparatuses described below. A first oscillating apparatus includes a prime mover, a rotation shaft connected to the prime mover, at least two cranks provided on the rotation shaft, two or more oscillating plates that are connected to the cranks via rods and distributed substantially symmetrically, and two or more slide guide mechanisms that are mounted to the oscillating plates and moves linearly the oscillating plates, characterized in that a rotational motion caused by the prime mover is converted into two opposite reciprocating motions by at least the two cranks provided on the rotation shaft, the two or more oscillating plates connected to at least the two cranks and distributed perform two opposite reciprocating motions along the slide guide mechanisms, and thus two or more oscillated products fixed to the oscillating plates are oscillated at the same time in opposite directions.

In the first oscillating apparatus according to the present invention, the rotation shaft is connected to the prime mover, and at least two cranks may be sufficient, and two or more cranks may be or may not be provided on each rotation shaft. A relationship between the cranks and the rotation shaft is not limited to one aspect, but various aspects can be considered. Generally, the two or more oscillating plates are distributed substantially symmetrically, generally with respect to the rotation shaft as a symmetry axis, but this is not limited as long as the two or more oscillating plates perform two opposite reciprocating motions. A preferable aspect will be exemplified below.

In the first oscillating apparatus according to the present invention, it is preferable that two or more rotation shafts are provided, and each rotation shaft has at least one crank and is one-dimensionally connected to the prime mover. The one-dimensional connection of the rotation shaft to the prime mover herein means that the rotation shaft and the prime mover are connected directly or via a predetermined conduction member.

A more specific aspect will be described below. A specific example of the first oscillating apparatus according to the invention includes a bed, a bed plate placed on the bed, two rotation shafts rotatably mounted perpendicularly to the bed plate and each having at least one crank, a prime mover connected to the two rotation shafts via a conduction member, two or more oscillation plates each connected to each crank of the two rotation shafts via a rod and distributed substantially symmetrically with respect to the two rotation shafts, and two or more slide guide mechanisms fixed to the bed plate and to which the oscillating plates are movably mounted, wherein a rotational motion caused by the prime mover is transmitted to the two rotation shafts, and converted into two opposite reciprocating motions by the crank provided on each of the two rotation shafts, and the distributed oscillating plates perform two opposite reciprocating motions substantially symmetrically with respect to the rotation shafts along the slide guide mechanism, thus oscillating the two or more oscillated products fixed to the oscillating plates at the same time in opposite directions.

In the first oscillating apparatus according to the present invention, it is preferable that two or more rotation shafts are provided and one-dimensionally or multi-dimensionally connected to the prime mover, and a final rotation shaft has at least two cranks. The multi-dimensional connection of the rotation shaft to the prime mover herein means an aspect such that a two-dimensional rotation shaft is connected to a-rotation shaft one-dimensionally connected, and a three-dimensional rotation shaft is connected to the two-dimensional rotation shaft. The final rotation shaft means a rotation shaft connected to an oscillating plate via a crank and a rod, and there may be one, or two or more final rotation shafts.

A more specific aspect will be described below. Another specific example of the first oscillating apparatus according to the invention includes a bed, a bed plate placed on the bed, a primary rotation shaft rotatably mounted to one surface of the bed plate, a prime mover connected to the primary rotation shaft via a primary conduction member, a secondary rotation shaft rotatably provided on the other surface of the bed plate, connected to the primary rotation shaft via a secondary conduction member, and having at least two cranks, two or more oscillation plates each connected to each crank of the secondary rotation shaft via a rod and distributed substantially symmetrically with respect to the secondary rotation shaft, and two or more slide guide mechanisms fixed to the bed plate and to which the oscillating plates are movably mounted, wherein a rotational motion caused by the prime mover is transmitted to the secondary rotation shaft via the primary rotation shaft, and converted into two opposite reciprocating motions by at least two cranks provided on the secondary rotation shaft, and the distributed oscillating plates perform two opposite reciprocating motions along the slide guide mechanisms, thus oscillating the two or more oscillated products fixed to the oscillating plates at the same time in opposite directions.

In the first oscillating apparatus according to the present invention, two or more oscillated products are oscillated at the same time in opposite directions, thus canceling vibration to reduce loads on the oscillated products and the apparatus itself. Further, it is not necessary to successively oscillate the oscillated products one by one, and a plurality of oscillated products can be efficiently treated at a time.

In the first oscillating apparatus according to the present invention, the rotational motion is converted into two opposite reciprocating motions by at least two cranks, thus the two cranks are provided so as to face diametrically opposite directions. The number of the cranks is at least two, but the number of forming aspects (directions) of the crank is two (two directions). Specifically, the crank serves to connect the oscillating plates for the reciprocating motions of the oscillating plates connected via the rods, and for this purpose, two or more, for example, four cranks may be provided, but also in this case, there are provided two cranks having the same forming aspect (facing the same direction) and two cranks having the same forming aspect but different from the former aspect.

In the first oscillating apparatus according to the present invention, the two opposite reciprocating motions of the two or more oscillating plates means reciprocating motions of two or more oscillating plates having substantially the same amplitude and the same direction, with cycles of the motions being shifted by a half cycle. Specifically, it refers to a motion such that when one moves forward, the other always moves backward. Two or more oscillating plates are mounted to two or more oscillating guide mechanisms, but the number of slide guide mechanisms and the number of oscillating plates may be the same or different, and for example, two oscillating plates may be mounted to four slide guides.

In the first oscillating apparatus according to the present invention, the distribution of the two or more oscillating plates means that substantially the same numbers of oscillating plates are placed on one side and the other side, but the numbers do not have to be completely the same. The oscillating plates perform two opposite reciprocating motions, thus the oscillated products fixed to the oscillating plates are oscillated at the same time in opposite directions to cause the above described advantages. An odd number of oscillating plates may provide the advantage by changing a placement balance. For example, when an even number (m) of oscillating plates are placed on one side, and an odd number (m−1) of oscillating plates are placed on the other side, the odd number of oscillating plates may be placed on an extension line of a symmetry axis with respect to adjacent two oscillating plates of the even number of oscillating plates.

Next, a second oscillating apparatus according to the present invention is characterized in that two or more oscillated products are oscillated at the same time in opposite directions, and vibration caused by the oscillation can be restrained. The oscillating apparatus according to the present invention simply referred to herein means both the first and the second oscillating apparatuses. The oscillating apparatus according to the invention is suitable for the case where the oscillated product is a mixture of a hollow product and a surface treatment material. The oscillating apparatus is suitable for the case where the oscillated product is a mixture of any one casting selected from an automotive air intake system parts group consisting of an intake manifold, turbine housing, compressor cover, cylinder head, and air duct, and the surface treatment material. Of course, not limited to this, a mixture of a work etc. with a burr, flash, scale, etc. and an abrasive or a grinding assistant is suitable as an oscillated product. For example, by putting them together in a container to fix the container to the oscillating plate and oscillate the container, grinding effects of the work can be achieved.

The surface treatment material preferably contains at least a polyhedral or spherical material. When the oscillated product is any one casting selected from the automotive air intake system parts group, the surface treatment material is preferably made of at least a metal material.

The oscillation herein does not mean rolling on a rotation orbit but means a reciprocating motion on a substantially linear orbit. The concept of oscillation overlaps that of vibration, and is not limited, but refers to a high speed cycle motion with a relatively large amplitude (also herein referred to as a stroke) and a low frequency of oscillation.

BRIEF DESCRIPTION OF THE DRAWINGS

The patent or application file contains at least one drawing executed in color. Copies of this patent or patent application publication with color drawings will be provided by the Office upon request and payment of the necessary fee.

DESCRIPTION OF THE PREFERRED EMBODIMENT

Figure 1:
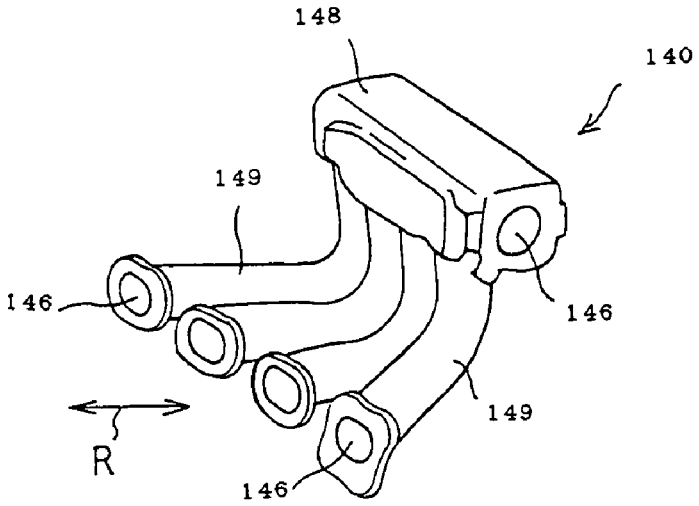
FIG. 1 is a perspective view of an embodiment of an intake manifold, showing an example of a surface treated product and an example of a hollow casting according to the invention.

Embodiments of the present invention will now be described in detail successively. The present invention is not construed as being limited to these embodiments, and various changes, modifications and improvements can be made based on the knowledge of those skilled in the art without departing from the scope of the present invention.

First, a surface treated product according to the present invention will be described. The surface treated product according to the present invention moves relatively in a fluid. The fluid herein generally refers to a gas or a liquid, but is not limited as long as the fluid can move relative to the surface treated product. For example, a particulate or powdery solid may be mixed in a gas or a liquid, or a particulate or powdery solid only may be used. Moving relatively means that either or both of the fluid and the surface treated product in the fluid move. The fluid may change its position relative to the surface treated product whose position is not changed, the surface treated product may change its position relative to the fluid whose position is not changed, or the surface treated product may change its position relative to the fluid whose position is changed.

The surface treated product means an object whose surface is artificially treated. The surface means all surfaces that may make contact with the fluid, and is not limited to external surfaces of the object. For example, for the surface treated product having a hollow portion, a surface of a wall portion defining the hollow portion corresponds to the surface herein, even if the surface is invisible from outside. The surface treated product according to the present invention has features on its surface, and there are three types of surface treated products according to the features.

A first surface treated product is characterized in that a surface of the first surface treated product has continuous dimples, each dimple having a diameter of 10 to 2500 μm and a depth of 50 μm or less. The dimple means a recess, and forming the dimples causes an uneven area to be formed on the surface of the surface treated product, which causes good turbulent flow and reduces pressure loss of a fluid passing through the uneven area. In this respect, the first surface treated product according to the present invention has the same operational advantage as the related art.

However, as described above, the first surface treated product according to the present invention is different from the related art in that extremely shallow dimples are continuously formed on the surface. In the related art, a diameter or a depth of a dimple is not specified, or it is presumed from its manufacturing method (pressing or casting) that the diameter and the depth are on the order of some millimeters. Further, in the related art, drawings etc. illustrate discontinuity of the dimples, or at least continuity is not affirmed. In this respect, the surface treated product according to the present invention has technical principles clearly different from those of the related art. The surface on which extremely shallow dimples are continuously formed is like a scraped surface. The scraped surface means a surface that is accurately scraped using a scraper, which is a type of hand tool for scraping metal. In the first surface treated product according to the present invention, the extremely shallow dimples are continuously formed, thus the surface before dimple forming does not clearly exist after the dimple forming. Further, the entire dimples and their edges are formed to be smooth. Thus, for example, when a fluid flows on such a surface, a layer of turbulent flow to be resistance is extremely thin, and the fluid can easily move near the surface. On the other hand, in the related art, the surface before dimple forming clearly exists after the dimple forming, the dimples are discontinuously formed, and each dimple is deep and has a sharp edge to easily cause turbulent flow to be resistance. This does not cause turbulent flow throughout the fluid, but slows the flow of the fluid near the surface.

In the first surface treated product, the dimple may be of a fixed shape such as a circular shape, or an indefinite shape. Preferably, the dimple is of an indefinite shape. When the dimple is not of a fixed circular shape, that is, the dimple is of an indefinite shape, a diameter means a diameter of a geometrically accurate largest circle inscribed in an outline of the dimple. The dimples may be continuously formed at least in some portions, and a percentage of dimples on the surface of the surface treated product is not limited, but a percentage by area of dimples is preferably 80% or more. More preferably, the percentage is 95% or more.

A second surface treated product is characterized in that a plurality of dimples each of which has a diameter of 10 to 2500 μm and a depth of 50 μm or less are formed on the surface of the second surface treated produce in a continuous manner, and that a surface roughness Ra of the surface is 10 μm or less. The surface roughness means surface roughness defined in JIS B0601 "Surface Roughness—Definition and Marking", and the surface roughness Ra means arithmetic average roughness defined in JIS B0601.

The surface of the second surface treated product has dimples like those of the first surface treated product, and has the surface roughness Ra of 10 μm or less, which is extremely high surface smoothness. Such an aspect significantly reduces pressure loss of the fluid flowing on the surface. Specifications or advantages of the dimples are similar to those of the first surface treated product, and descriptions thereof will be omitted.

More specifically, the first and the second surface treated products are preferably castings molded by casting. This is because a surface treatment method according to the present invention described later can be easily performed on castings, resulting in easily obtaining castings as the first and the second surface treated products according to the present invention. The first and the second surface treated products each have a hollow portion formed by a wall portion, and the surface having the above described features is a surface of the wall portion defining the hollow portion. The surface treated product having hollow portion defined by the wall portion herein is referred to as a hollow product, and the surface of the wall portion facing the hollow portion is referred to as an internal surface of a hollow product.

A third surface treated product according to the present invention is characterized in that the third surface treated product is a casting molded by casing and has a hollow portion formed by a wall portion, and the surface of the wall portion defining the hollow portion has surface roughness Ra of 10 μm or less. The casting herein having hollow portion defined by the wall portion is referred to as a hollow casting, and the surface of the wall portion facing the hollow portion is referred to as an internal surface of a hollow casting. Specifically, the third surface treated product according to the present invention is the hollow casting whose internal surface has the surface roughness Ra of 10 μm or less.

Unlike the first and the second surface treated products, the third surface treated product does not always require dimples. The surface of the casting is originally uneven, the internal surface of the hollow casting is difficult to treat, and there has been no hollow casting whose internal surface has the surface roughness Ra of 10 μm or less. In this respect, the third surface treated product according to the present invention has superiority. The surface of the casting is originally uneven as described above, and even if the surface roughness Ra is 10 μm or less, extremely shallow continuous uneven shapes remain to improve a flow state of a fluid on the surface on which the fluid flows.

The third surface treated product according to the invention has to be a hollow casting. The first and the second surface treated products according to the present invention maybe, but not limited, a hollow product or a hollow casting. The first and the second surface treated products according to such an aspect of the present invention can be used suitably as various piping, trough-like products, or ducts that often require improvement of a flow state of a fluid on a surface of an object on which the fluid flows.

Further, the first and the second surface treated products according to the present invention that are hollow products and castings (that is, hollow castings), and the third surface treated product according to the present invention can be molded into desirable shapes according to molds because of being castings. As suitable applications of the hollow casting according to the present invention, automotive air intake system parts can be cited. The automotive air intake system parts means parts for a system for supplying or exhausting air or an air-fuel mixture to an engine cylinder, including an intake manifold, turbine housing, compressor cover, cylinder head (intake and exhaust port), and air duct.

By these parts having the features of the first, the second, and the third surface treated products (also simply referred to as the surface treated products according to the present invention), the intake and exhaust resistance of a portion reaching the engine cylinder can be decreased, so that even on the same engine, the output thereof can be increased. In particular, for a high speed rotation type engine, the automotive air intake system parts made of the first, the second, and the third surface treated products according to the present invention are effective. This is because, with increasing flow velocity of the mixture, air intake resistance increases, but pressure loss reduction effects relatively become more noticeable.

FIG. 1 is a perspective view of an example of an intake manifold, which is an example of the surface treated product according to the invention. An intake manifold 140 is an intake pipe for a four-cylinder engine, which is formed by four branch pipes 149 which are branched from a surge tank 148 and each connected to each intake port of a cylinder of the engine. In order to increase the intake efficiency of a mixture (gasoline and air) viewed from the engine, a surface of a wall portion facing a hollow portion 146 requires to be smoothed, from the viewpoint of the role of the intake manifold 140, so as to reduce air intake resistance in the hollow portion 146.

Figure 2:
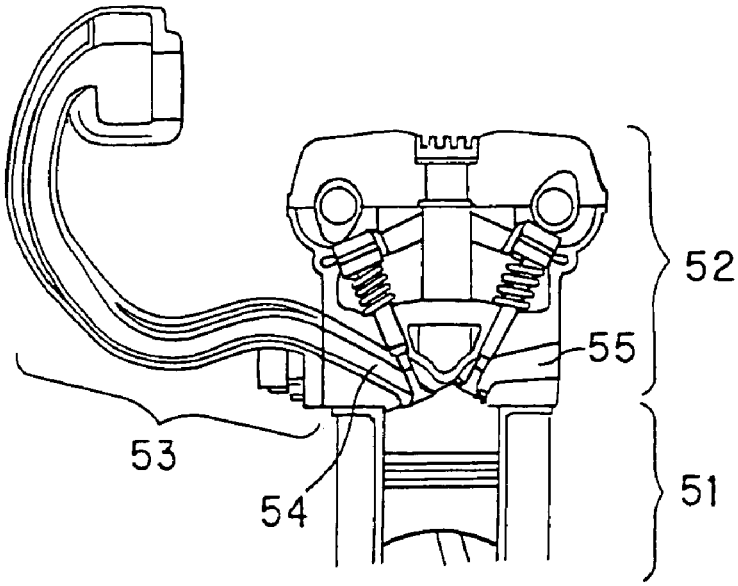
FIG. 2 is a sectional view of an embodiment of a cylinder head and an intake manifold, showing an example of the surface treated product and an example of the hollow casting according to the invention.

FIG. 2 is a sectional view mainly showing a cylinder head of an engine, which is an example of the surface treated product according to the present invention. A cylinder head 52 having an intake port 54 and an exhaust port 55 is provided on a cylinder block 51 in which a piston moves vertically, and further an intake manifold 53 is connected to the cylinder head 52. For example, air filtered by an unshown air cleaner passes through the intake manifold 53, and is mixed with fuel by an unshown fuel injector etc. to form an air-fuel mixture. The air-fuel mixture is supplied into the cylinder block 51 through the intake port 54 in the cylinder head 52 by the opening operation of an intake valve, and is burned by an unshown ignition plug.

Further, the air duct is an intake pipe for connecting the air cleaner to the intake manifold. The turbine housing is an impeller chamber for converting exhaust gas into rotational power on an automobile provided with a turbocharger. The compressor cover is an impeller chamber for sending intake gas under pressure.

When the surface treated product according to the present invention is the casting molded by casting, including the hollow casting as described above, the surface treated product is preferably made of cast iron or a light alloy for casting as a principal raw material. The light alloy means an aluminum alloy, a magnesium alloy, etc.

The cast iron means an iron-carbon alloy containing a predetermined amount of carbon. The type of cast iron is not limited, but it is preferable that spherical graphite cast iron having higher mechanical properties is used. For the aluminum alloy for casting among light alloys for casting, various types are available according to whether heat-treated or not, contained other elements, and their composition, and the type of aluminum alloy is not limited. However, it is preferable that an aluminum alloy specified as JIS symbol AC in Japanese Industrial Standard is used. For example, AC4C and AC3A, etc. can be cited.

The first and the second surface treated products according to the present invention may be surface treated products that move relatively in a fluid, and a fluid for relative motion and a material forming the surface treated products themselves are not limited. Of course, the shape thereof is not limited to a hollow product. Suitable applications of the first and the second surface treated products, which are not hollow castings, according to the present invention, include a refrigeration cycle, a heat exchanger tube, a pipe type jumper apparatus, an intake pipe or an exhaust pipe that is not a casting, etc. as described in Patent documents 1 to 5. Further applications include various piping, a duct, a trough, a side groove, etc. which are made of resin, metal, ceramic, or concrete through which various gases or liquids pass, a hull or parts thereof moving with some parts in the air and other parts in water, or bodies or parts of an airplane, an automobile, a train, etc. moving in the air.

Next, a surface treatment method according to the present invention will be described. The surface treatment method according to the present invention is a method for treating a surface of a surface treated product that moves relatively in a fluid. The surface treatment method according to the present invention is characterized in that a surface treatment material containing a polyhedral or spherical material having a diameter of 5 mm or more is caused to collide with the surface. This causes the surface treatment material to grind the surface by sliding, or slightly crush and deform the surface to improve smoothness.

In the surface treatment method according to the present invention, the surface treatment material is not limited, but is preferably made of two or more types of materials. The two or more types means either or both of two or more materials and two or more shapes. The two or more shapes allow reduction of surface portions with which the surface treatment material is hard to collide. The two or more materials allow control of a degree of deformation of the surface.

Further, the collision is preferably caused by oscillation of either or both of the surface treated product and the surface treatment material. For example, a method in which the surface treated product and the surface treatment material are placed together in a certain enclosed space to oscillate either or both of them, or a closed space having a surface to be treated of the surface treated product is provided and the surface treatment material is put in the space to oscillate the surface treated product, or other methods can be used. According to the means, a smooth recessed surface or a smooth surface can be formed more quickly compared to a matt surface according to the conventional means such as ejecting a surface treatment material made of sand or powder on a surface of a surface treated product.

Now, the case will be described where the surface treated product has a hollow portion formed by a wall portion, and a surface of the wall portion defining the hollow portion (an internal surface of a hollow product) is to be treated. In this case, the surface treatment material can be put in the hollow portion to close the hollow portion, and the surface treated product can be oscillated to cause a collision.

The surface treatment material having hardness suitable for the material forming the hollow product is put in the hollow portion, and the opening of the hollow portion is closed. The hollow product is oscillated under preferable oscillating conditions of oscillation amplitude, frequency, and oscillation time, for example, by using a surface treatment apparatus described later. By doing so, the surface treatment material repeatedly collides with the internal surface of the hollow product.

The volume of the surface treatment material put in the hollow portion is preferably about 5 to 70% of the volume of the hollow portion. The purpose of this is to ensure that the surface treatment material moves freely within the hollow portion, and the number of collisions of the surface treatment material with the internal surface of the hollow casting is maintained at a predetermined level. If the volume of the surface treatment material is less than 5%, although the surface treatment material moves freely within the hollow portion, the volume of the surface treatment material is too low with respect to the area of the internal surface of the hollow product. As a result, the number of collisions of the surface treatment material with the internal surface of the hollow product and the pressurizing force are not maintained at a predetermined level, so that the internal surface of the hollow product is undesirably difficult to become smooth. If the volume of the surface treatment material is more than 70%, the range in which the surface treatment material moves freely within the hollow portion is limited, and thus the number of collisions of the surface treatment material with the internal surface of the hollow product and the pressurizing force are not maintained at a predetermined level, so that similarly, the whole of the internal surface of the hollow product is undesirably difficult to become smooth.

Hereunder, oscillating conditions for causing the surface treatment material to collide with the internal surface of the hollow product will be described. In the surface treatment method according to the present invention, the oscillating conditions are not limited when the surface treated product is the hollow product and the oscillation causes the collision, but the following conditions are more desirable. The oscillating conditions when the surface treatment material is not the hollow product are not limited.

The frequency is preferably about 5 to 20 Hz. The purpose of this is to maintain the number of collisions of the surface treatment material with the internal surface of the hollow product per unit time at a predetermined level. If the frequency is lower than 5 Hz, the number of collisions of the surface treatment material with the internal surface of the hollow product is not maintained at a predetermined level, so that the surface treatment material cannot smooth the internal surface of the hollow product thoroughly, and thus the surface roughness cannot be improved desirably. Also, depending on the number of surface treatment materials, even if the frequency is higher than 20 Hz, the effect of improving surface roughness is small, and the effectiveness of energy consumed to increase the frequency undesirably decreases. The frequency herein means the number of oscillations repeated per unit time, and the unit thereof is hertz (Hz).

Also, the amplitude of oscillation is preferably about 30 to 200 mm. The purpose of this is to maintain the number of collisions of the surface treatment material with the internal surface of the hollow product per unit time at a predetermined level by properly setting the movement range of the surface treatment material within the hollow portion. If the amplitude of oscillation is smaller than 30 mm, the number of collisions of the surface treatment material with the internal surface of the hollow product is not maintained at a predetermined level, so that the surface treatment material cannot smooth the internal surface of the hollow product thoroughly, and thus the surface roughness cannot undesirably be improved. Even if the amplitude of oscillation is larger than 200 mm, the time during which the surface treatment material is in contact with the internal surface of the hollow product is merely lengthened, and the number of collisions of the surface treatment material with the internal surface of the hollow product does not increase, so that the effect of improving the surface roughness is not great.

Further, the total oscillation time is preferably about 3 to 120 minutes. The purpose of this is to maintain the total number of collisions of the surface treatment material with the internal surface of the hollow product. If the total oscillation time is shorter than 3 minutes, the total number of collisions of the surface treatment material with the internal surface of the hollow product is not maintained, and thus the surface treatment material cannot smooth the whole of the internal surface of the hollow product, which undesirably causes variations in surface roughness. Also, even if the total oscillation time is longer than 120 minutes, the effect of improving the surface roughness is small, and the effectiveness of time taken to manufacture the hollow casting undesirably does not increase.

Now, the case will be described where the surface treated product is a hollow casting, and the surface to be treated is an internal surface of the hollow casting. As described above, the method, in which the surface treated product is the hollow product, the internal surface of the hollow product is to be treated, the surface treatment material is put in the hollow portion to close the hollow portion, the surface treated product is oscillated, and the surface treated product is caused to collide with the internal surface of the hollow product, is particularly useful for the case where the surface treated product is the hollow casting, and the surface to be treated is the internal surface of the hollow casting.

The internal surface of the hollow casting has been difficult to treat, so that means such as using a core having a smooth surface has been used in order to smooth the internal surface of the hollow casting. In this case, the surface roughness Ra of the internal surface of the hollow casting is about 8.8 μm at the lower limit, and about 12.5 to 15 μm on an average. By using the surface treatment method according to the present invention, the surface roughness Ra of the internal surface of the hollow casting can be easily made 10 μm or less.

A core has been prepared by being molded using sand having an especially small grain size and by applying a facing material to enhance the smoothness of the internal surface, but there is no need for this preparation and the cost for manufacturing the core can be reduced. Further, a thin hollow core has been used because gas is difficult to release by coating with the facing material. This degreases the core strength, and a crack is liable to be generated, and thus burrs are sometimes formed, but the possibility of such problems can be reduced significantly according to the present invention.

Figure 6A:
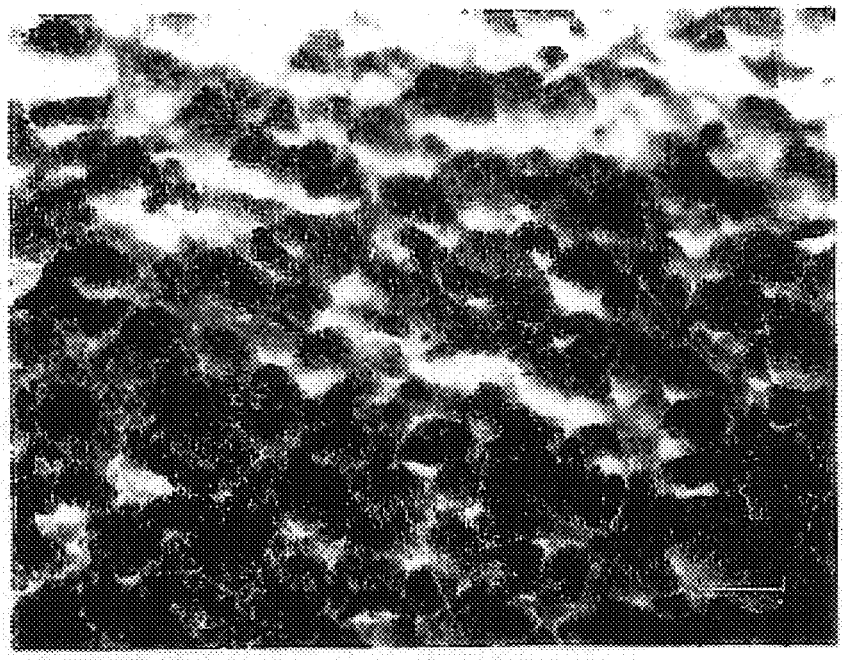
FIGS. 6(*a*) and 6(*b*) show an example of an internal surface of a hollow casting treated by the surface treatment method according to the present invention, FIG. 6(*a*) is an optical microscope photograph (10× magnification) of a surface viewed from above, and FIG. 6(*b*) is an optical microscope photograph (10× magnification) of a section of the surface.
Figure 6B:
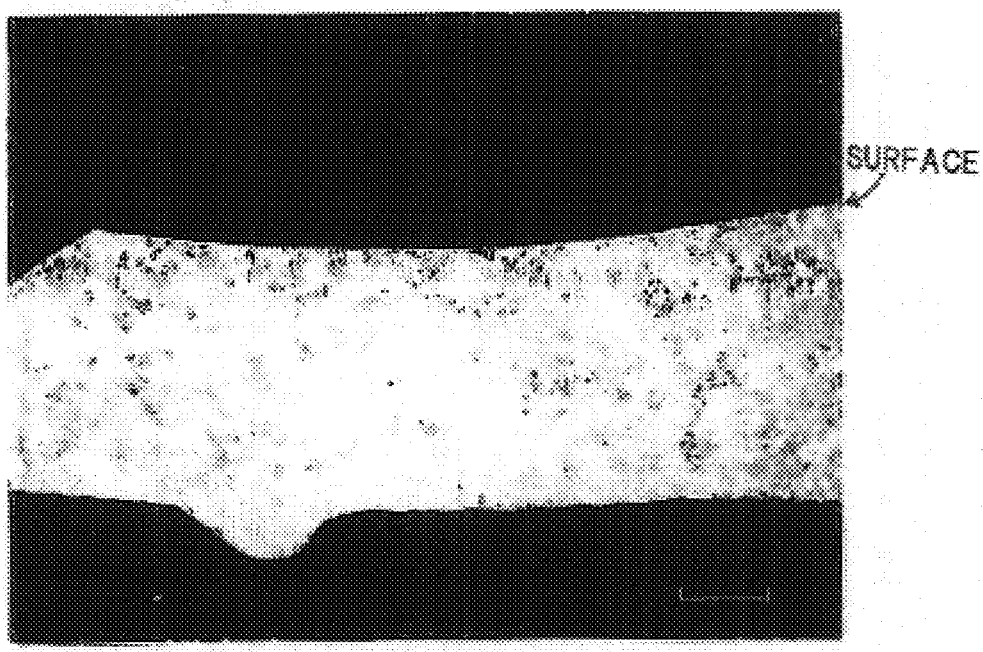
Figure 7A:
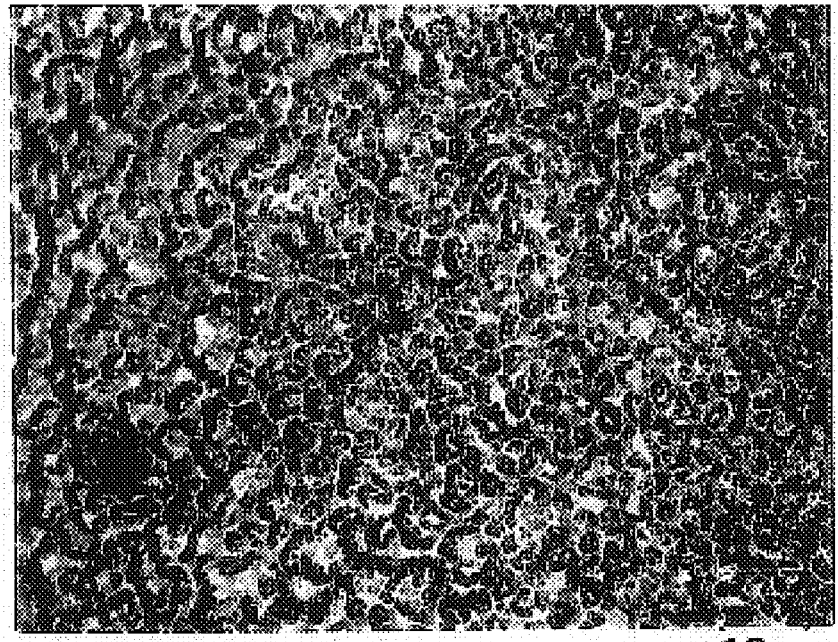
FIGS. 7(*a*) and 7(*b*) show an example of an internal surface of a conventional hollow casting, FIG. 7(*a*) is an optical microscope photograph (10× magnification) of a surface viewed from above, and FIG. 7(*b*) is an optical microscope photograph (10× magnification) of a section of the surface.
Figure 7B:
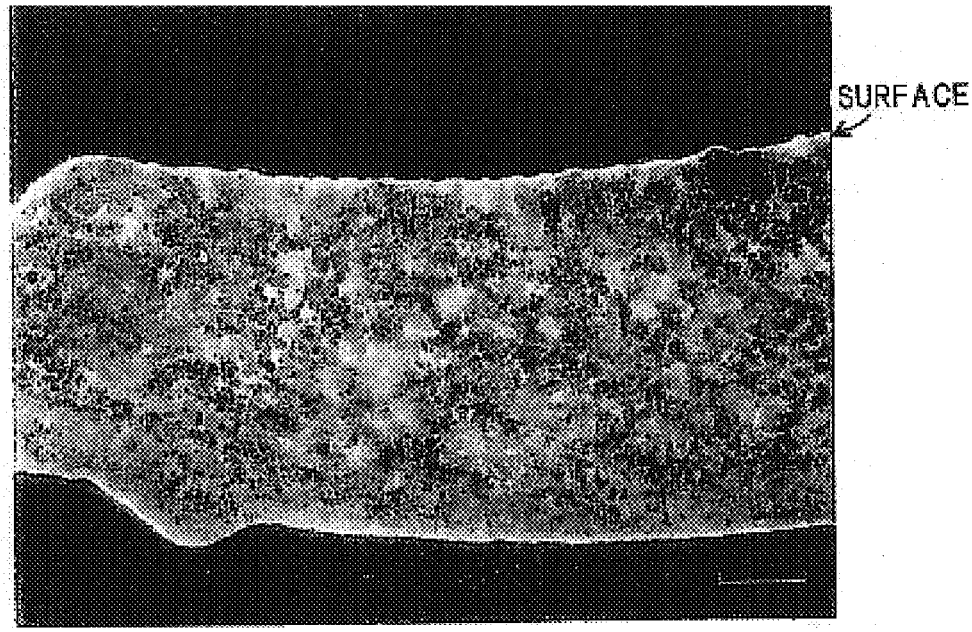
Figure 8A:
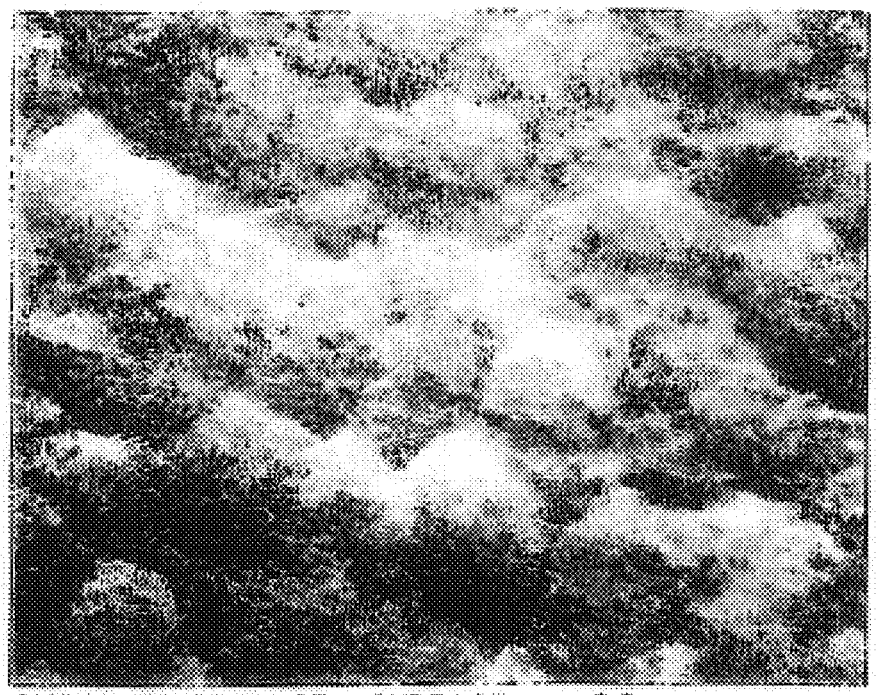
FIGS. 8(*a*) and 8(*b*) show the example of the internal surface of the hollow casting treated by the surface treatment method according to the present invention, FIG. 8(*a*) is an optical microscope photograph (20× magnification) of the surface viewed from above, and FIG. 8(*b*) is an optical microscope photograph (20× magnification) of the section of the surface.
Figure 8B:
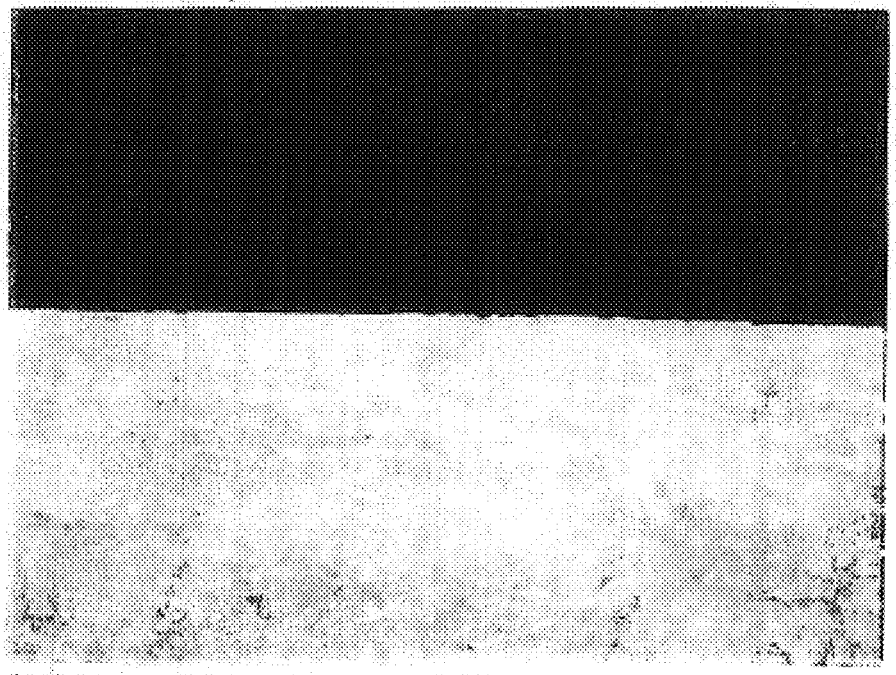
Figure 9A:
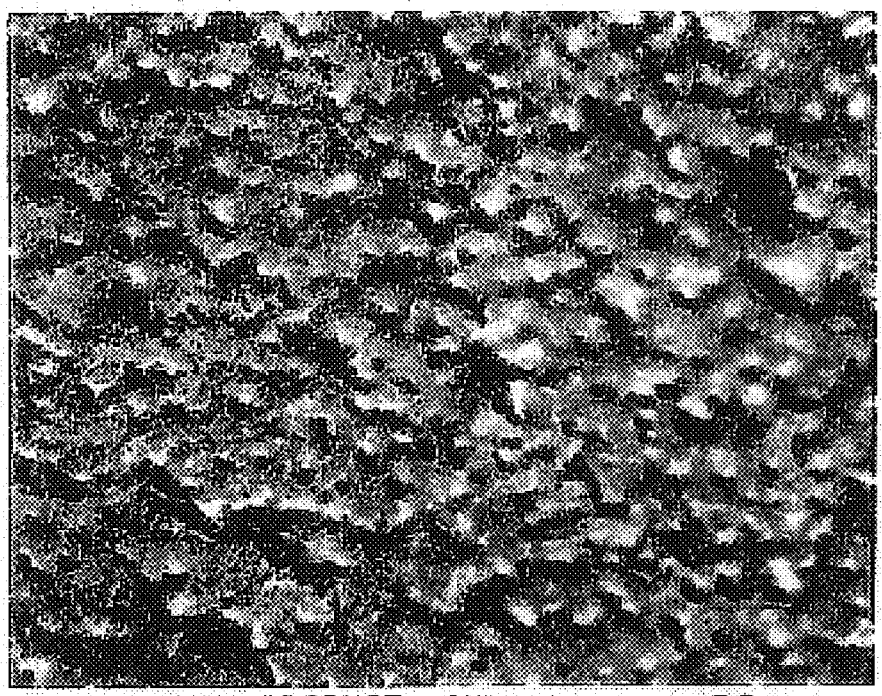
FIGS. 9(*a*) and 9(*b*) show the example of the internal surface of the conventional hollow casting, FIG. 9(*a*) is an optical microscope photograph (20× magnification) of the surface viewed from above, and FIG. 9(*b*) is an optical microscope photograph (20× magnification) of the section of the surface.
Figure 9B:
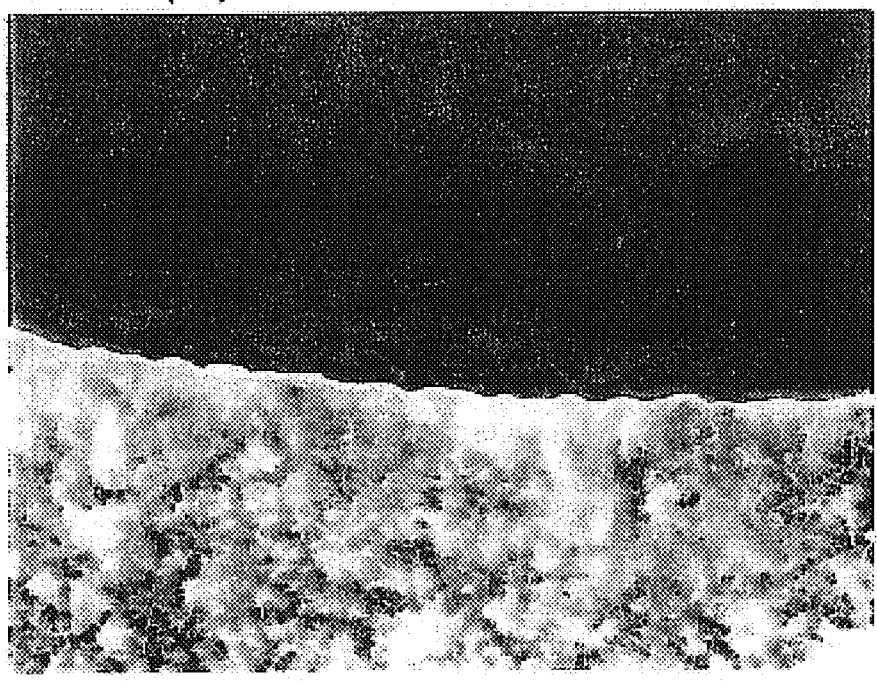
Figure 10A:
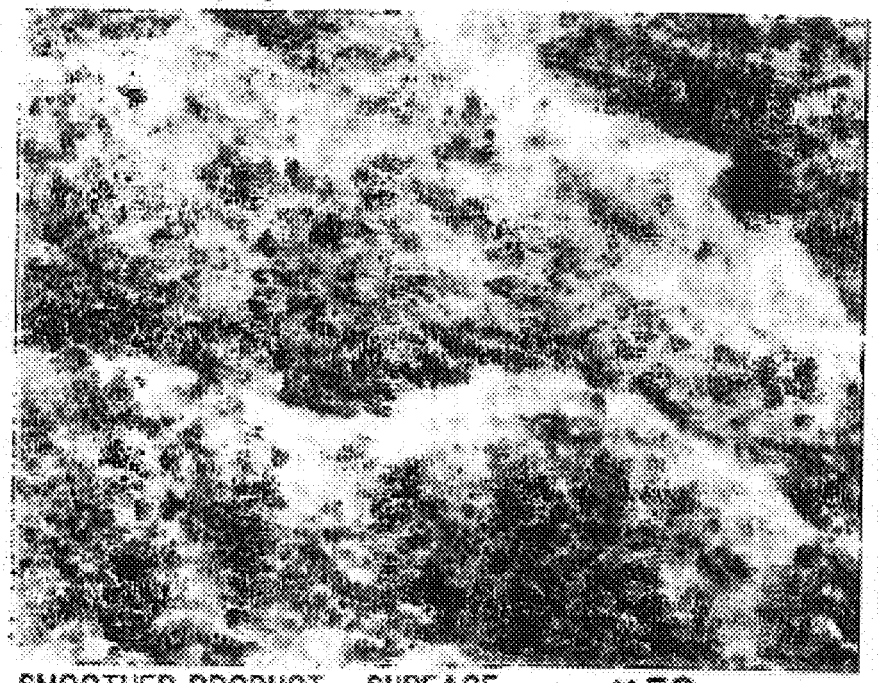
FIGS. 10(*a*) and 10(*b*) show the example of the internal surface of the hollow casting treated by the surface treatment method according to the present invention, FIG. 10(*a*) is an optical microscope photograph (50× magnification) of the surface viewed from above, and FIG. 10(*b*) is an optical microscope photograph (50× magnification) of the section of the surface.
Figure 10B:
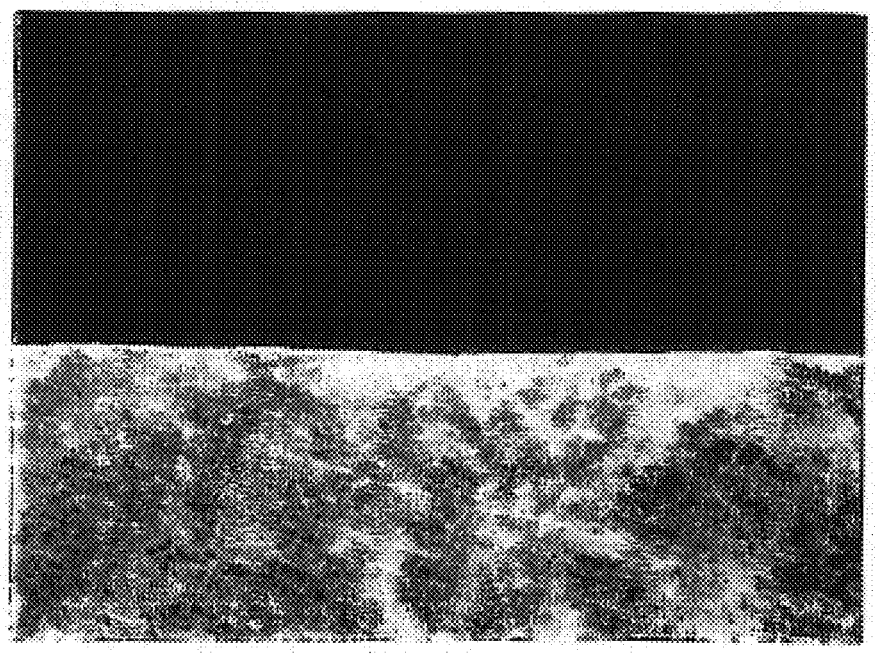
Figure 11A:
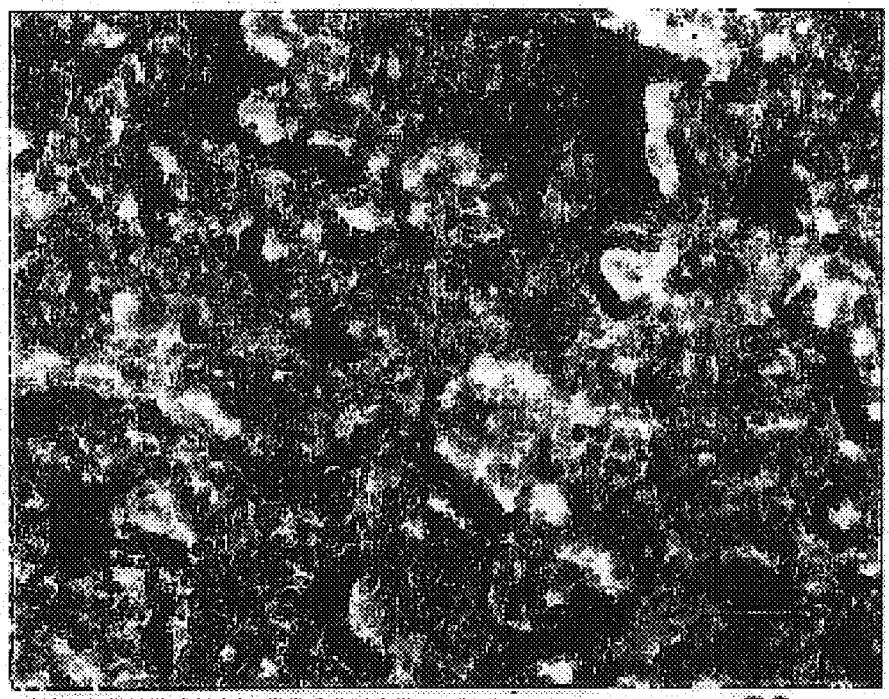
FIGS. 11(*a*) and 11(*b*) show the example of the internal surface of the conventional hollow casting, FIG. 11(*a*) is an optical microscope photograph (50× magnification) of the surface viewed from above, and FIG. 11(*b*) is an optical microscope photograph (50× magnification) of the section of the surface.
Figure 11B:
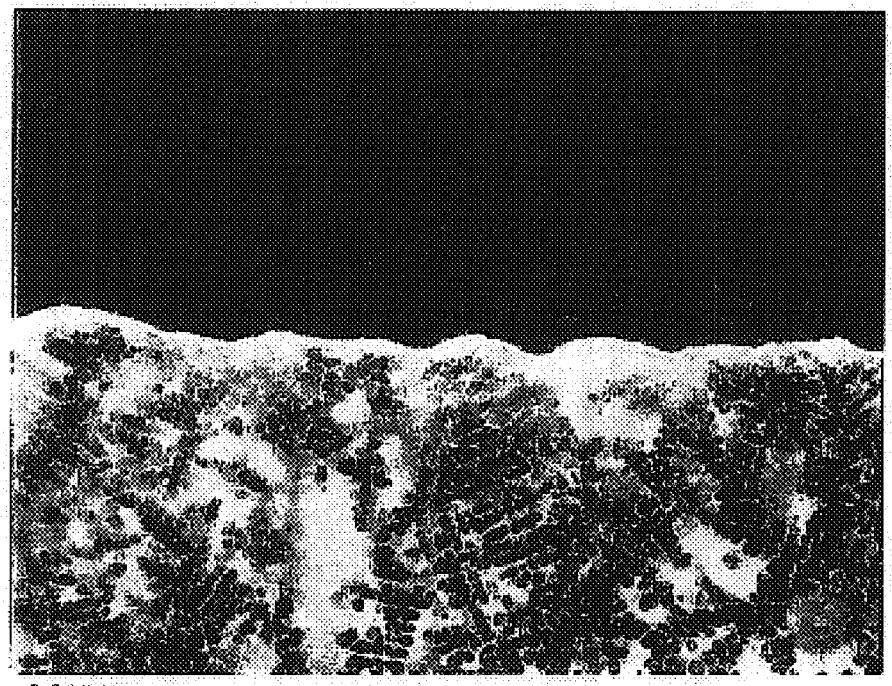

For the surface treatment method of a hollow casting according to the present invention, the surface treatment material repeatedly collides with the internal surface of the hollow casting to improve the surface roughness of the internal surface of the hollow casting, thus forming smooth dimples on the treated internal surface of the hollow casting. FIGS. 7(*a*) (10× magnification), 9(*a*) (20× magnification), and 11(*a*) (50× magnification) are optical microscope photographs of a casting surface of the hollow casting that is not treated, viewed from above, and FIGS. 7(*b*) (10× magnification), 9(*b*) (20× magnification), and 11(*b*) (50× magnification) are optical microscope photographs of a section of the casting surface of the hollow casting that is not treated. On the other hand, FIGS. 6(*a*) (10× magnification), 8(*a*) (20× magnification), and 10(*a*) (50× magnification) are optical microscope photographs of a casting surface of a hollow casting that is smoothed by the surface treatment method according to the present invention, viewed from above, and FIGS. 6(*b*) (10× magnification), 8(*b*) (20× magnification), and 10(*b*) (50× magnification) are optical microscope photographs of a section of the casting surface of the hollow casting that is smoothed by the surface treatment method according to the present invention. As shown, the dimple is not of a fixed shape like a protrusion or a recess formed by a mold as in the related art (pressing or casting), but of an indefinite shape.

When the hollow casting is oscillated, the opening of the hollow portion requires to be closed, and it is preferable that an external space following the hollow portion is formed in the end portion. If the opening of the hollow portion is closed without the formation of the external space, the surface treatment material is difficult to move to the opening end portion, so that the surface roughness of the opening end portion is undesirably not improved.

Figure 3:
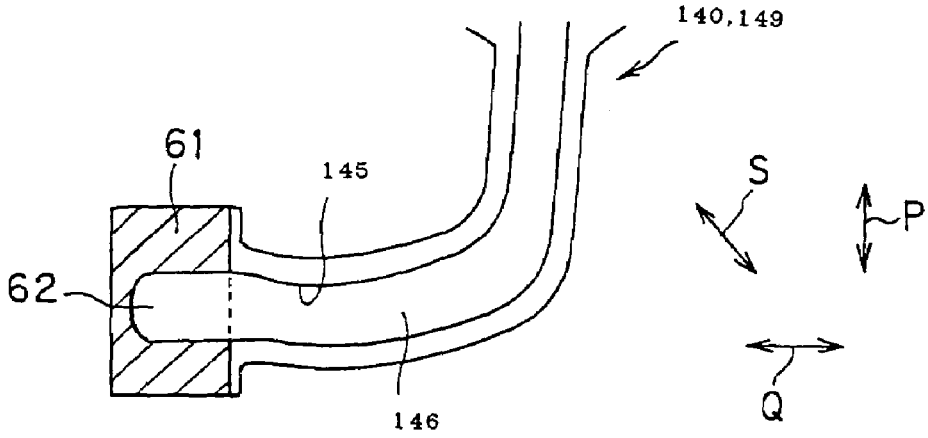
FIG. 3 is a sectional view of an embodiment of a surface treatment method according to the present invention.

An example of the external space is shown in FIG. 3. FIG. 3 is a sectional view showing a state in which the opening of the branch pipe 149 of the intake manifold 140 shown in FIG. 1 is closed by a cover 61. Since an external space 62 is formed by the cover 61, the surface treatment material put in the hollow portion 146 is moved freely even in the opening end portion of the hollow portion 146 by oscillating the intake manifold 140, so that the surface of a wall portion 145 can be treated uniformly. All of the opening end portions are closed. The formation of the external space can be applied to the case where the surface treated product is a hollow product produced by the method other than the casting.

When the hollow casting is oscillated, it is preferable that the direction in which the hollow casting is oscillated is selected so that the number of collisions of the surface treatment material with the internal surface of the hollow casting is maintained at a predetermined level. The preferable direction differs according to the shape of the hollow portion of the hollow casting.

For example, when the intake manifold 140 shown in FIGS. 1 and 3 is oscillated, in which the surge tank 148 and the branch pipes 149 cross each other, it is not preferable that the intake manifold 140 is oscillated in either lengthwise direction of the hollow portion 146 thereof, that is, in the direction indicated by the arrow mark Q or P in FIG. 3. This is because the percentage of the surface treatment material having a long movement distance in the hollow portion 146 increases, and the number of collisions of the surface treatment material with the internal surface of the hollow casting caused by the oscillation decreases. The preferable oscillating direction when the intake manifold 140 is oscillated is the direction indicated by the arrow mark S in FIG. 3 or the arrow mark R in FIG. 1. It is also preferable that the direction is changed during the oscillation. The selection of the oscillation direction can be applied to the case where the surface treated product is a hollow product produced by the method other than the casting.

In the surface treatment method according to the present invention, as described above, the surface treatment material is not limited, but preferably contains, at least in part, a polyhedral or spherical material (also referred to as a block) made of a metal material, because the surface treatment material also serves to remove sand when the hollow casting is to be treated, and the material forming the hollow casting is cast iron or an aluminum for casting.

The surface treatment material preferably contains, for example, metal balls or cut wires. The metal balls or cut wires may be used without being mixed with other materials, or may be used as a mixture of two or more materials by being mixed with metal particles, abrasives, dry sand, etc. Also, metal balls having different sizes are preferably used as blocks. This is because it can be thought that by mixing surface treatment materials having different sizes, the surface treatment materials repeat collisions and scraping with respect to the internal surface of the hollow casting uniformly and thoroughly, and also the internal surface of the hollow casting is pressed and enters a coining state, by which the smoothness of the internal surface of the hollow casting can be improved.

The diameter of the metal ball or the length of the cut wire, or the material forming the metal ball or the cut wire may be determined by considering the material forming the hollow casting, the cross-sectional area of the hollow portion of the hollow casting, etc., and is not limited. More specifically, in the case of an automotive air intake system part in which the hollow casting is made of an aluminum alloy, steel balls or stainless steel balls having a diameter of 5 to 20 mm and stainless steel cut wires having a diameter of 0.6 to 1.2 mm and a length of 0.6 to 1.2 mm can be used suitably.

Next, a surface treatment apparatus according to the present invention will be described. The surface treatment apparatus according to the present invention is an apparatus for artificially treating a surface of an object. A hollow product is an example of the object, and in this case, all surfaces including an internal surface and an external surface of the hollow product are to be treated. The surface treatment apparatus according to the present invention is characterized by including: fixing means for fixing an object in which a surface treatment material is put in an enclosed space having the surface as a forming surface in an arbitrary direction; and oscillating means for oscillating the fixing means.

Figure 4:
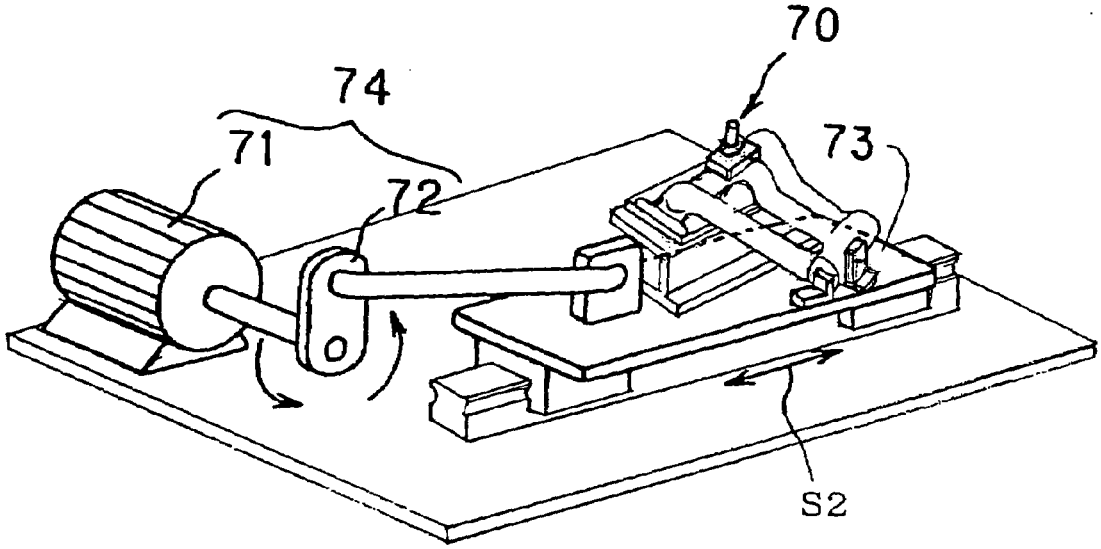
FIG. 4 is a perspective view of an embodiment of a surface treatment apparatus according to the present invention.

FIG. 4 is a perspective view of an embodiment of a surface treatment apparatus. A surface treatment apparatus 70 includes oscillating means 74 and a bed 73 on which a hollow product is placed and fixed. The oscillating means 74 is made up of a prime mover 71 and a crank 72 connected to the prime mover 71. A rotational motion caused by the prime mover 71 is converted into a reciprocating motion by the crank 72, by which the bed 73 can be oscillated in the direction indicated by the arrow mark S2. The bed 73 may have a specific shape in the case where the shape of the hollow casting and the oscillating direction are fixed, or may be flat. The shape of the bed 73 is not limited as long as the bed 73 can fix the hollow casting in an arbitrary direction. Further, the bed 73 may have a jig for fixing the hollow product.

For example, in order to oscillate the intake manifold 140 shown in FIGS. 1 and 3 by using the surface treatment apparatus 70, it is necessary only that a predetermined surface treatment material is put in the hollow portion 146, the intake manifold 140, in which each opening of the hollow portion 146 has been closed while the external space is formed, is fixed on the bed 73 so that the slant direction indicated by the arrow mark S (FIG. 3) coincides with the direction indicated by the arrow mark S2, which is the oscillating direction of the surface treatment apparatus 70, and the prime mover 71 is operated.

The surface treated product, the surface treatment method, and the surface treatment apparatus according to the present invention have been described. Now, a manufacturing method of a hollow casting according to the present invention will be described.

When a molded product having a space therein (that is, having a hollow portion), such as a trough-like product or a pipe, is manufactured by a simple casting process, as molds, a core for forming the hollow portion is used in addition to a master mold.

Figure 19:
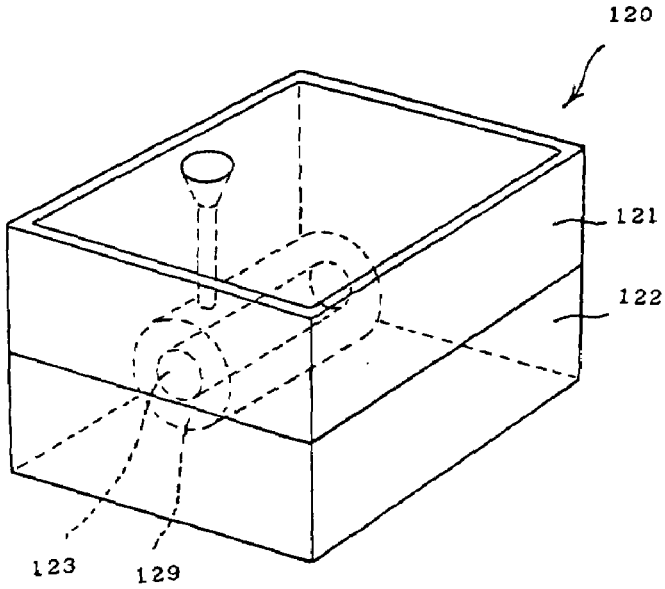
FIG. 19 is a perspective view of an example of a mold for a hollow casting.
Figure 20:
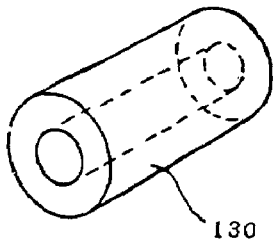
FIG. 20 is a perspective view of an example of a hollow casting.
Figure 21:
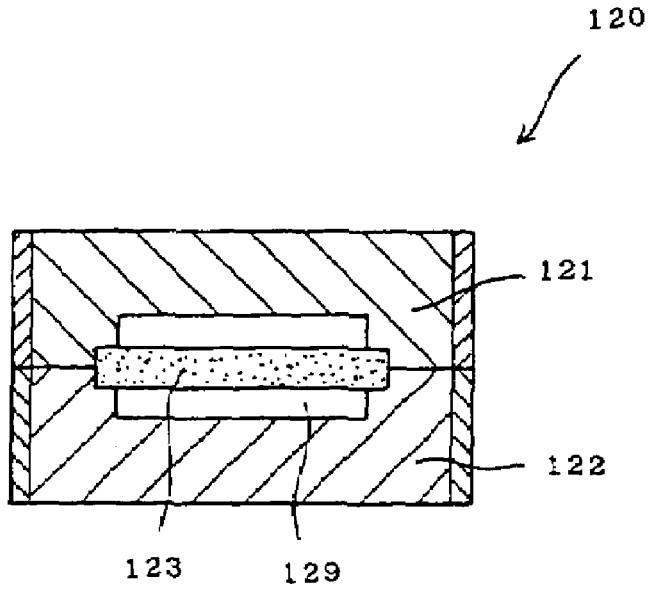
FIG. 21 is a sectional view of the mold shown in FIG. 19.

For example, in order to obtain a hollow casting 130 shown in FIG. 20, a mold 120 shown in FIG. 19 (perspective view) and FIG. 21 (sectional view) can be used. The mold 120 consists of an upper mold 121 and a lower mold 122 that are molded by a sand mold, and a sand core 123, and is formed with a cavity 129 corresponding to the hollow casting 130.

Generally, after molten metal is poured into the cavity 129 and is solidified, the upper mold 121, the lower mold 122, and the core 123 are collapsed, whereby the hollow casting 130 can be obtained. As the core 123, for example, a molded object formed into a desirable shape by hardening, for example, sand with a thermosetting resin used as a binder is used. In the case where the shape of the hollow casting is more complex, however, there arises an unsolved problem in that the manufacture of the core and the removal of the core after casting take much time and labor, and the environmental load is high.

Hereunder, problems with the conventional manufacturing method of a hollow casting will be described by taking an intake manifold, which is one of automotive air intake system parts, as an example of a hollow casting having a more complex shape (see Patent document 4 as a related art document concerning an intake manifold). The intake manifold is an intake pipe formed by using, for example, an aluminum alloy as a principal raw material and is used to supply air to cylinders of an engine.

FIG. 1 is a perspective view of an example of the intake manifold. An intake manifold 140 is an intake pipe for a four-cylinder engine, which is formed by four branch pipes 149 which are branched from a surge tank 148 and each connected to each intake port of a cylinder of the engine. In order to increase the intake efficiency of a mixture (gasoline and air) viewed from the engine, a surface of a wall portion facing a hollow portion 146 requires to be smoothed, from the viewpoint of the role of the intake manifold 140, so as to reduce air intake resistance in the hollow portion 146. To meet this requirement, in casting the intake manifold, a core having a smooth surface has conventionally been used.

However, in order to smooth the surface of the core, the core must be formed by using sand etc. having small grain size, and must be subjected to surface treatment such as coating with a facing material in case of the conventional method. For the core whose surface is coated with the facing material, gas generated from the resin for hardening the sand etc. is difficult to release, so that the core must be made in a hollow form in which the thickness is decreased to the utmost. This decreases the core strength, and hence a crack is liable to be generated on the surface during handling. For the intake manifold manufactured by using the core with a crack generated on the surface, molten metal intrudes into a cracked portion, and burrs are produced on the surface of the wall portion facing the hollow portion 146, so that the surface becomes rather rough. Therefore, since the smoothness of the core surface has a certain limit, the smoothness of the surface of the wall portion facing the hollow portion of the intake manifold also has a limit.

In the case of a hollow casting having a shape like the intake manifold 140, since the hollow portion is bent, joined, and separated, when the core is removed, a part of the core is liable to remain in the hollow portion. Therefore, the core is once collapsed and taken out by applying a shock to the hollow casting or by burning sand, and after appearance finishing etc. is performed, the remaining core sand must again be removed. At this time, the remaining core sand is difficult to remove completely by simple shot blasting operation. Therefore, conventionally, the remaining sand has been often removed by horning, in which silica sand and beads are mixed and ejected at a predetermined pressure (see Japanese Patent Laid-Open No. 7-308751 (Patent document 9) as a related art document of a removing method of core sand).

However, the initial equipment cost and operation cost of a compressor and a dust collector for performing horning etc. are needed, and also the removed core sand or fine particles produced by a horning material etc. requires to be disposed of. Further, when cutting is performed in the subsequent process, residual matters such as core sand, if any, contaminate a cutting oil, and damage a cutter blade, so that the change interval becomes short, which increases wastes.

The above is a description of problems with the related art which has been given by taking the intake manifold as an example of a hollow casting. Accordingly, it is required to provide means for manufacturing a casting having a hollow portion defined by a wall portion, in which a wall portion defining the hollow portion is smooth, without increasing an environmental load during the manufacturing process.

Studies on the conventional manufacturing method including a process for removing a core after casting has been reviewed and researches thereon has been carried out. As a result, it has been found that the above described request can be met by the manufacturing method of a hollow casting described below.

Now, embodiments of the manufacturing method of a hollow casting according to the present invention will be described in detail. The manufacturing method of a hollow casting according to the present invention is a method for manufacturing a casting having a hollow portion formed by a wall portion using a master mold of a metal mold and a core of a sand mold. A casting process is not limited, and may include what is called a die casting process (high-speed injection) and a low-pressure casting process (low-speed injection). The casting process may be any process in which molten metal is poured into a mold having a cavity of a predetermined shape to perform molding. The manufacturing method of a hollow casting according to the present invention is characterized in that after casting is performed by using the master mold and the sand core, a core removing processing and a smoothing processing of the wall portion defining the hollow portion (also referred to as an internal surface of a hollow casting) are performed at the same time.

Figure 18:
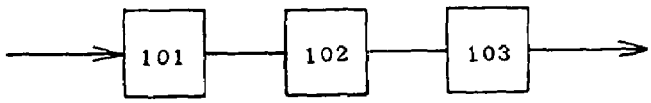
FIG. 18 a block flow of a process, showing an example of a manufacturing method of a hollow casting according to the present invention.

As shown in FIG. 18, the manufacturing method of a hollow casting according to the present invention has, for example, a casting step 101, an appearance finishing step 102, and an internal surface finishing step 103. The outline of the manufacturing method including these steps will be as described below.

First, a predetermined material is prepared as a raw material and is melted to be molten metal. Then, the molten metal is subjected to cleaning treatment as necessary. The molten metal is poured into a mold, and is molded by cooling etc. (the casting step 101). Next, burrs etc. produced on an obtained molded product (a hollow casting) are removed to finish the outside shape (the appearance finishing step 102). Subsequently, the core is collapsed and removed to the utmost. Smoothing materials constituted by, for example, metal balls and cut wires are put in the hollow portion of the hollow casting. The hollow casting is oscillated to remove remaining sand and residues and to smooth the internal surface (the internal surface finishing step 103). Thereafter, heat treatment may be carried out as necessary to improve mechanical properties of the hollow casting.

Now, the internal surface finishing step 103 will be described in detail. The smoothing material having hardness suitable for the material forming the hollow casting is put in the hollow portion defined by the wall portion, and the opening of the hollow portion is closed, then the hollow casting is oscillated. Thereby, the smoothing material repeatedly collides with the internal surface of the hollow casting to strip the remaining sand and residues from the casting surface, and the smoothing material grinds the internal surface of the hollow casting by sliding, or slightly crushes and deforms the internal surface of the hollow casting to improve smoothness of the internal surface of the hollow casting.

The smoothing material preferably contains metal balls inclusive of the one having pores having at least slightly larger, but smaller than the diameter of the hollow portion or cut wires having a size of smaller than that of the metal balls. The metal balls or cut wires may be used without being mixed with other materials, or may be used as a mixture of two or more materials by being mixed with metal particles, abrasives, dry sand, etc. More preferably, a mixture containing at least slightly larger metal balls is used. Also, metal balls having different sizes are preferably used. By mixing smoothing materials having different sizes, the smoothing materials repeatedly collide with the internal surface of the hollow casting uniformly and thoroughly, and thus the residual matters can be easily removed. Also, the internal surface of the hollow casting is pressed by mixing the slightly larger metal balls, by which the smoothness of the internal surface of the hollow casting is improved.

The diameter of the metal ball or the length of the cut wire, or the material forming the metal ball or the cut wire may be determined by considering the material forming the hollow casting, the cross-sectional area of the hollow portion of the hollow casting, etc., and is not limited. For example, in the case of an automotive air intake system part in which the hollow casting is made of an aluminum alloy, steel balls or stainless steel balls having a diameter of 10 to 20 mm and stainless steel cut wires having a diameter of 0.6 to 1.2 mm and a length of 0.6 to 1.2 mm can be used suitably.

Also, the above described smoothing material is preferably put in the hollow portion so that the volume thereof is about 5 to 70% of the volume of the hollow portion of the hollow casting. The purpose of this is to ensure that the smoothing material moves freely within the hollow portion, and the number of collisions of the smoothing materials with the internal surface of the hollow casting is maintained at a predetermined level.

According to the above described manufacturing method of a hollow casting according to the present invention, unlike the conventional method, horning is not performed as a separate step to remove residual matters, and the thorough removal of the core and the smoothing of the internal surface are carried out at the same time. Therefore, the manufacturing process is shortened, and a compressor and a dust collector used for horning etc. become unnecessary. In addition, fine powders generated during horning treatment etc. do not adhere to the internal surface of the hollow portion. Therefore, when cutting is performed in the subsequent process, a cutting oil is less liable to be contaminated, and a cutter blade is less liable to be damaged, so that the production of wastes is restrained.

The manufacturing method of a hollow casting according to the present invention is a useful one, in the point that not only the environmental load is reduced owing to a less consumption of energy resulting in the reduction in the formation of carbon dioxide due to the omission of the compressor and the dust collector, but also the production of wastes is reduced due to a less contamination of the cutting oil and a more prolonged life of the cutter blade, and it is applicable to the manufacturing of any types of hollow casting.

As suitable applications of the hollow casting manufactured by the manufacturing method of a hollow casting according to the present invention, automotive air intake system parts can be cited. The manufacturing method of a hollow casting according to the present invention is suitable for the automotive air intake system parts because the manufacturing method removes residual matters from the hollow portion of the obtained hollow casting, and smoothes the wall portion defining the hollow portion, and therefore passage resistance of a fluid is reduced, and the fluid is not contaminated.

Now, the automotive air intake system part will be described. FIG. 2 is a sectional view mainly showing a cylinder head of an engine. A cylinder head 52 having an intake port 54 and an exhaust port 55 is provided on a cylinder 51 in which a piston moves vertically, and further an intake manifold 53 is connected to the cylinder head 52. For example, air filtered by an unshown air cleaner passes through the intake manifold 53, and is mixed with fuel by an unshown fuel injector etc. to form an air-fuel mixture. The air-fuel mixture is supplied into the cylinder 51 through the intake port 54 in the cylinder head 52 by the opening operation of an intake valve, and is burned by an unshown ignition plug. The air duct is an intake pipe for connecting the air cleaner to the intake manifold.

The manufacturing method of a hollow casting according to the present invention preferably uses cast iron or a light alloy for casting as a principal raw material of molten metal. The type of cast iron is not limited, but it is preferable that spherical graphite cast iron having higher mechanical properties is used. For the aluminum alloy for casting among light alloys for casting, various types are available according to whether heat-treated or not, contained other elements, and their composition, and the type of aluminum alloy is not limited. However, it is preferable that an aluminum alloy specified as JIS denotation AC in Japanese Industrial Standard is used. For example, AC4C and AC3A, etc. can be cited.

The manufacturing method of a hollow casting according to the present invention has been described. Now, a sand removing method of a hollow casting according to the present invention will be described.

When a molded product having a space therein (that is, having a hollow portion), such as a trough-like product or a pipe, is manufactured by a simple casting process, as molds, a core for forming the hollow portion is used in addition to a master mold.

For example, in order to obtain a hollow casting 130 shown in FIG. 20, a mold 120 shown in FIG. 19 (perspective view) and FIG. 21 (sectional view) can be used. The mold 120 consists of an upper mold 121, a lower mold 122, and a core 123, and is formed with a cavity 129 corresponding to the hollow casting 130. As the core 123, for example, a molded object formed into a desirable shape by hardening, for example, sand with a thermosetting resin used as a binder is used. Generally, after molten metal is poured into the cavity 129 and is solidified, the upper mold 121 and the lower mold 122 are opened, and the core 123 is collapsed, whereby the hollow casting 130 can be obtained.

In the case where the shape of the hollow casting is more complex, however, there arises a problem in that sand produced when the core is collapsed is not easily removed particularly from a casting surface forming the hollow portion, and the removal takes much labor.

Hereunder, problems with the conventional sand removing method of a hollow casting will be described by taking an intake manifold, which is one of automotive air intake system parts, as an example of a hollow casting having a more complex shape (see Patent document 4 as a related art document concerning an intake manifold). The intake manifold is an intake pipe formed by using, for example, an aluminum alloy as a principal raw material and is used to supply air to cylinders of an engine.

FIG. 1 is a perspective view of an aspect of the intake manifold. An intake manifold 140 is an intake pipe for a four-cylinder engine, which is formed by four branch pipes 149 which are branched from a surge tank 148 and each connected to each intake port of a cylinder of the engine. The hollow portion 146 of the intake manifold 140 is a portion through which a mixture (gasoline and air) passes, and is formed by using the core.

In the case of a hollow casting having a more complex shape like the intake manifold 140, since the hollow portion formed by the core is bent, joined, and separated. Therefore, the core is first collapsed by applying a shock or by burning sand, and then the core sand is to be removed. However, the removal of sand from the casting surface forming the hollow portion takes much labor.

The remaining core sand on the casting surface is difficult to remove by simple shot blasting operation. Therefore, conventionally, the remaining sand has been removed by horning, in which silica sand and beads are mixed and ejected at a predetermined pressure, means for spraying pressurized water in the atmosphere or with the hollow casting immersed in water, or means for vibrating the hollow casting itself by chipping or hammering (see Patent document 9, Japanese Patent Laid-Open No. 9-182952 (Patent document 10), and Japanese Patent Laid-Open No. 11-188477 (Patent document 11), as related art documents of a removing method of core sand). However, even by these means, in the case of the hollow casting having the bent hollow portion such as the intake manifold 140, the cores sand is not easily removed particularly from the bent hollow portion, and the removal takes much labor.

The problems with the conventional sand removing method of a hollow casting have been described by taking the intake manifold as an example of the hollow casting. Thus, it is required to provide means for sufficiently removing the core sand from the casting surface, without taking much labor, even of a casting of a simple shape or a complex shape with a bent hollow portion.

Studies on the conventional problems have been reviewed and researches for new methods have been carried out. As a result, it has been found that the above described request can be met by the sand removing method of a hollow casting according to the present invention described below.

The sand removing method according to the present invention is a method for removing sand from a surface of a casting having a hollow portion formed by a wall portion, and more particularly a method that exhibits excellent advantages in that sand can be easily removed from a surface of a wall portion defining a hollow portion (an internal surface of a hollow casting), the removal of sand from the hollow portion having conventionally taken much labor. The surface of the casting herein does not mean a casting surface, that is, a surface just being cast. The casting surface generally has small uneven shapes, and removal of sand therefrom takes much labor. Therefore, the sand removing method of a hollow casting according to the present invention is useful for removing the sand from the casting surface, but the sand removing method of a hollow casting is not limited to this case, and can be applied to, for example, the case where predetermined treatment is performed on a surface to increase labor for removal of sand from the surface. The sand to be removed mainly means sand remaining on a surface of a casting after a sand core is collapsed, but according to the present invention, besides sand, foreign matters corresponding to sand may be removed. For example, a solidified facing material etc. maybe removed. Further, the removal of sand from the surface of the wall portion defining the hollow portion is herein also referred to as the removal of sand from the internal surface of the hollow casting or simply as the removal of sand from the hollow portion. These wordings have the same meaning because the sand is not suspended in a space of the hollow portion.

The sand removing method of a hollow casting according to the present invention is characterized in that a shock application material is put in hollow portion defined by the wall portion and the casting is oscillated. The shock application material having hardness suitable for the material forming the hollow casting is put in hollow portion defined by the wall portion, and the opening is closed. The hollow casting is oscillated under preferable oscillating conditions of oscillation amplitude, frequency, and oscillation time, described below, by which the shock application material repeatedly collides with the whole of the internal surface of the hollow casting. Thereby, the shock application material causes a shock and vibration throughout the hollow casting, and the shock and vibration cause all sand including the sand remaining on the internal surface of the hollow portion to leave the casting surface, and to be ejected more easily.

It is apparent from the fact that sand cannot be easily removed by the conventional chipping and hammering that the removal of sand takes much time and labor simply by continuous vibration. Even if the entire hollow casting is vibrated, the sand is not ejected from the casting surface. The removal of the sand requires a shock. By the conventional chipping and hammering, sand has not been easily removed from a position apart from a point of vibrating action, while in the sand removing method of a hollow casting according to the present invention, the shock application material moves freely within the hollow portion to apply the shock throughout the internal surface of the hollow casting. Thus, the sand can be easily removed from the whole surface of the casting including the whole of the internal surface of the hollow casting.

In the conventional chipping and hammering, there is a significant difference between a shock at the point of vibrating action and a shock at a point apart therefrom, and the shock is too large at the point of vibrating action to cause a crack on the casting, while in the sand removing method of a hollow casting according to the present invention, the shock application material moves freely within the hollow portion to apply the same shock throughout the internal surface of the hollow casting, thus preventing a crack on the casting.

When the hollow casting is oscillated, an opening of the hollow portion is closed. In this case, it is preferable that an external space following the hollow portion is formed in the end portion. If the opening of the hollow portion is closed without the formation of the external space, the shock application material is difficult to move to the opening end portion, so that sand undesirably accumulates on the opening end portion.

Figure 22A:
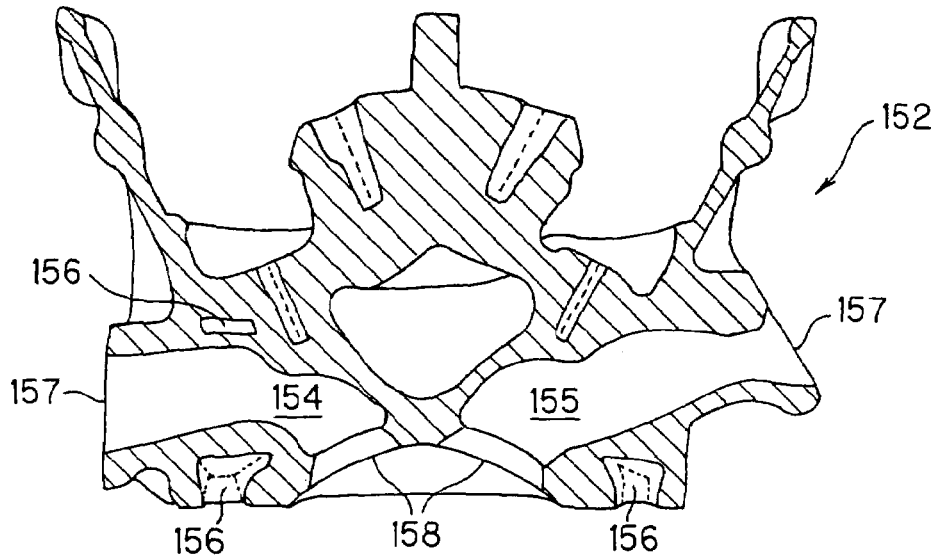
FIGS. 22(*a*) and 22(*b*) show a cylinder head being cut, which is an example of the hollow casting, FIG. 22(*a*) is a side view when a facing surface of the cylinder head is the underside, and FIG. 22(*b*) shows the facing surface of the cylinder head (the underside in FIG. 22(*a*)).
Figure 22B:
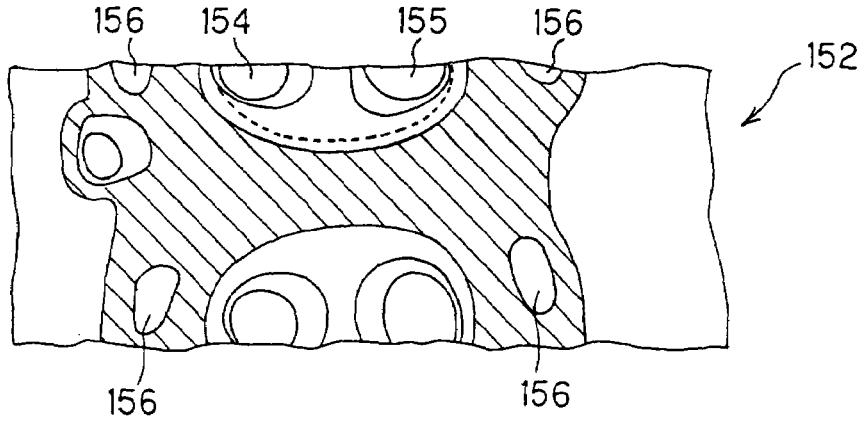

Also, sand can be also removed from a hollow portion in which no shock application material is put, by a shock and vibration caused by putting the shock application material in a part of hollow portions and oscillating the shock application material. For example, for a cylinder head 152 shown in FIGS. 22(*a*) and 22(*b*), an intake port 154 and an exhaust port 155 are formed as a closed space, and a shock application material is put therein to oscillate the cylinder head 152, thus allowing removal of sand remaining in cooling water channels 156 that are a plurality of small hollow portions in which no shock application material is put. FIGS. 22(*a*) and 22(*b*) are cutaway views for illustration, and in the cylinder head 152 which is not cut, the hollow portion is formed by the intake port 154 and the exhaust port 155 having an (intake or exhaust) manifold connection port 157 and an (intake or exhaust) valve port 158 as opening ends. Therefore, by closing the opening ends by covers, a closed space can be formed by the intake port 154 and the exhaust port 155.

The shock application material is preferably constituted by metal balls having a diameter of about 3 to 30 mm, and may contain metal balls having the same diameter or a mixture of metal balls having different diameters. Further, metal particles or abrasives may be mixed.

More preferably, the shock application material is a mixture of metal balls having different diameters. By mixing shock application materials having different sizes, the shock application material repeats movement with respect to the internal surface of the hollow casting uniformly and thoroughly, and slightly larger metal balls apply shocks enough to remove the sand to the internal surface of the hollow casting.

The diameter of the metal ball or the material forming the metal ball may be determined by considering the material forming the hollow casting, the cross-sectional area of the hollow portion of the hollow casting, etc. The diameter is preferably 3 to 30 mm, but is not limited. For example, in the case of an automotive air intake system part in which the hollow casting is made of an aluminum alloy, steel balls or stainless steel balls having a diameter of 10 to 20 mm can be suitably used.

The shock application material is preferably put in the hollow portion so that the volume thereof shares about 5 to 50% of the volume of the hollow portion of the hollow casting. Besides, hollow portions in which the shock application material is put are not always all of the hollow portions of the casting, but preferably formed throughout the casting. The purpose of this is to ensure that the shock application material move freely within the hollow portion, the number of collisions of the shock application material with the internal surface of the hollow casting is maintained at a predetermined level, and the shock and vibration caused by the collisions are sufficiently applied to the internal surface of the hollow casting.

Now, oscillating conditions of the hollow casting for causing the shock application material to collide with the internal surface of the hollow casting to cause a shock will be described. In the case of the sand removing method of a hollow casting according to the present invention, there is no limitation as far as oscillating conditions are concerned, but preferably as described below.

The frequency is preferably about 5 to 20 Hz. The purpose of this is to maintain the number of collisions of the shock application material with the internal surface of the hollow casting per unit time at a predetermined level. If the frequency is lower than 5 Hz, the number of collisions of the shock application material with the internal surface of the hollow casting is not maintained at a predetermined level, so that the shock caused by the collision cannot undesirably remove sand quickly and sufficiently. Also, depending on the number of shock application materials (for example, steel balls), the sand is removed at the frequency of about 20 Hz, so that even if the frequency is higher than 20 Hz, the effectiveness of energy consumed undesirably decreases.

Also, the amplitude of oscillation is preferably about 30 to 200 mm. The purpose of this is to maintain the number of collisions of the shock application material with the internal surface of the hollow casting per unit time at a predetermined level by properly setting the movement range of the shock application material within the hollow portion. If the amplitude of oscillation is smaller than 30 mm, the number of collisions of the shock application material with the internal surface of the hollow casting is not maintained at a predetermined level, so that the shock caused by the collision cannot undesirably remove sand quickly and sufficiently. Even if the amplitude of oscillation is larger than 200 mm, the time during which the shock application material is in contact with the internal surface of the hollow casting is merely lengthened, and the number of collisions of the shock application material with the internal surface of the hollow casting does not increase, so that the sand is not easy to remove.

Further, the total oscillation time is preferably about 1 to 120 minutes. The purpose of this is to maintain the total number of collisions of the shock application material with the internal surface of the hollow casting. If the total oscillation time is shorter than 1 minute, the total number of collisions of the shock application material with the internal surface of the hollow casting is not maintained, so that the sand on the internal surface of the hollow casting is not undesirably sufficiently removed. Also, depending on other conditions, the sand is thoroughly removed in about 120 minutes, thus even if the total oscillation time is longer than 120 minutes, the effectiveness of time taken to manufacture the hollow casting undesirably does not increase.

In the sand removing method of the hollow casting according to the present invention, it is preferable that the direction in which the hollow casting is oscillated is selected so that the number of collisions of the shock application material with the internal surface of the hollow casting is maintained at a predetermined level. The direction may be determined according to the shape of the hollow portion of the hollow casting. For example, when the intake manifold 140 shown in FIG. 1 is oscillated, it is not preferable that the intake manifold 140 is oscillated in either lengthwise direction of the hollow portion 146 thereof. This is because the percentage of the shock application material having a long movement distance in the hollow portion 146 increases, and the number of collisions of the shock application material with the internal surface of the hollow casting caused by the oscillation decreases. The preferable oscillating direction when the intake manifold 140 is oscillated is, for example, the direction indicated by the arrow mark R in FIG. 1. It is also preferable that the direction is changed during oscillation.

The sand removing method of a hollow casting according to the present invention has been described. Now, an oscillating apparatus according to the present invention will be described.

As a method for removing or cleaning a burr, flash, scale, etc. on a work, for example, barreling is known. Barreling is grinding means in which an object to be treated such as a work is put in a container together with an abrasive or a grinding assistant such as silica sand, and the container is oscillated, by which the object to be treated repeatedly collides with the abrasive or the grinding assistant to smooth and clean a surface of the object to be treated. The barreling is grinding means that is often used, and has features of allowing automated operation, adjustment of finishing by selecting the abrasive or the grinding assistant, and grinding of the whole surface of the object to be treated at the same time.

Generally, grinding including the barreling produces vibration, dust, noise, etc., and influences on operational environments or environments around a plant should be noted. In many cases, it is sufficient to use a special grinder providing for dust collection, noise insulation, and vibration insulation, but if the object to be treated is a casting such as an automotive part, a plurality of castings cannot be accommodated in the grinder at a time because of a large size of the object. Also, some collisions of the objects to be treated with each other are to be avoided. At this time, the conventional grinder requires separate processing in succession, which does not increase processing efficiency and is not suitable for mass production. On the other hand, increasing the number of grinders increases the amount of processing per unit time, but also increases equipment costs.

Japanese Patent Laid-Open No. 2001-30064 (Patent document 8) is a related art document concerting an apparatus like the oscillating apparatus. In the document, a vibration generating apparatus used in a method for removing powdery and particulate matters adhered to an internal wall surface of a cavity of a work of a cast product is disclosed, though the apparatus is not for grinding.

The conventional problems have been described. Therefore, means for efficiently oscillating the work with vibration, dust, etc. restrained. It is also required that grinding or other surface treatment can be performed on the work by the oscillating means.

Studies on the conventional problems have been reviewed and researches for new methods have been carried out. As a result, it has been found that the above described request can be met by the oscillating method according to the present invention described below.

Figure 12:
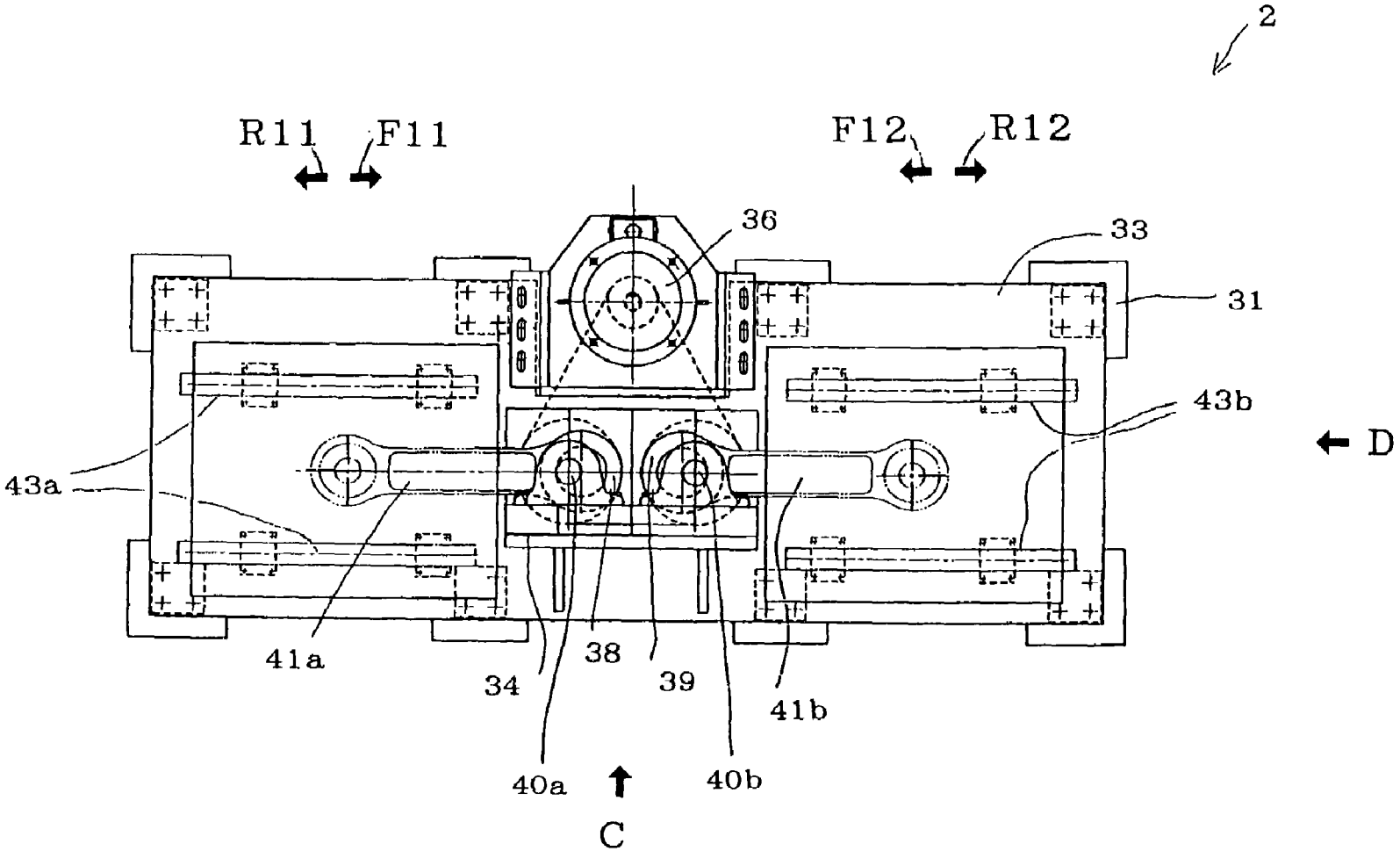
FIG. 12 is a top view of an embodiment of an oscillating apparatus according to the present invention.
Figure 14:
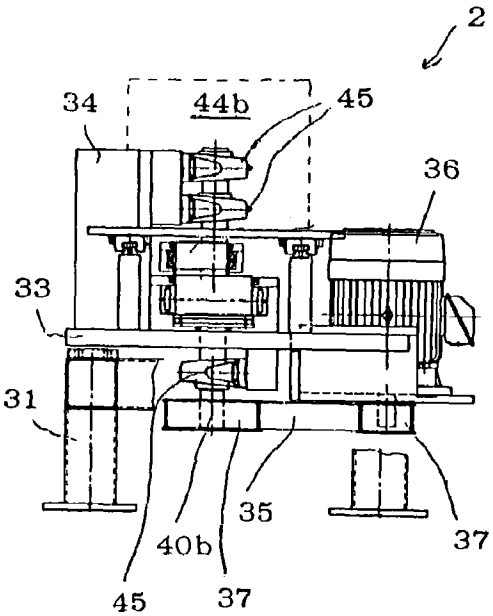
FIG. 14 is a view, partially in perspective, of the oscillating apparatus taken in the direction of arrow D in FIG. 12.
Figure 13:
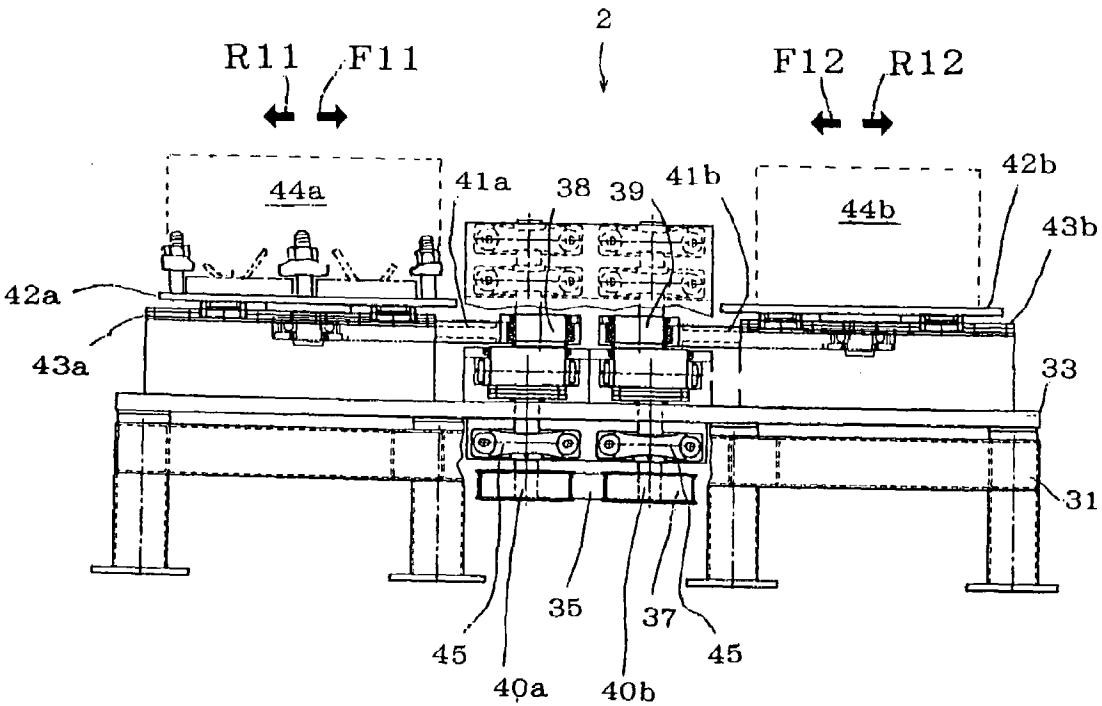
FIG. 13 is a view, partially in perspective, of the oscillating apparatus taken in the direction of arrow C in FIG. 12.

FIG. 12 is a top view of an embodiment of an oscillating apparatus according to the present invention, FIG. 13 is a view (side view) taken in the direction of arrow C in FIG. 12, and FIG. 14 is a view taken in the direction of arrow D in FIG. 12.

In an oscillating apparatus 2 as shown, power for oscillation is provided by a prime mover 36. A rotational motion caused by the prime mover 36 is transmitted to two rotation shafts 40*a*, 40*b* by a conduction member 35 to rotate the shafts. The two rotation shafts 40*a*, 40*b* rotate at the same time, but the rotational motions thereof are converted into two opposite reciprocating motions by cranks 38, 39 provided on the rotation shafts 40*a*, 40*b*, respectively. Specifically, an oscillating plate 42*a* connected to the crank 38 via a rod 41*a* performs a reciprocating motion along a linear bearing 43*a* that is one of slide guide mechanisms, an oscillating plate 42*b* connected to the crank 39 via a rod 41*b* performs a reciprocating motion along a linear bearing 43*b* that is one of slide guide mechanisms, and the reciprocating motions are performed such that when the oscillating plate 42*a* moves in a direction F11, the oscillation plate 42*b* moves in a direction F12, and when the oscillating plate 42*a* moves in a direction R11, the oscillation plate 42*b* moves in a direction R12. In other words, the oscillating plates 42*a*, 42*b* perform reciprocating motions in opposite directions symmetrically with respect to the two rotation shafts 40*a*, 40*b* as their symmetrical axes.

The reciprocating motions cause, at the same time, oscillation of an oscillated product 44*a* and an oscillated product 44*b* fixed on the oscillating plate 42*a* and the oscillating plate 42*b*, respectively, and vibration caused by the reciprocating motion of the oscillating plate 42*a* and the oscillation of the oscillated product 44*a* and vibration caused by the reciprocating motion of the oscillating plate 42*b* and the oscillation of the oscillated product 44*b* cancel each other. Thus, the operational environments are improved to reduce influences on the environments around the plant.

In the oscillating apparatus 2, a bed plate 33 is placed on a bed 31, and all components including the prime mover 36 are mounted to the bed 31. The prime mover 36 may be provided on a vibration insulating bed. The shown prime mover 36 is an electric motor, but not limited to the electric motor, the prime mover may be an internal combustion engine etc. in the present invention.

A rotation shaft mounting bracket 34 is provided on the bed plate 33, a bearing 45 is mounted to the rotation shaft mounting bracket 34, and another bearing 45 is mounted to an underside of the bed plate 33. The two rotation shafts 40*a*, 40*b* are rotatably mounted perpendicularly to the bed plate 33 by the plurality of bearings 45. The two rotation shafts 40*a*, 40*b* are connected to a rotation shaft of the prime mover 36 via one conduction member 35.

The conduction member 35 is, for example, a V belt, and transmits the rotational motions via pulleys 37 provided on the rotation shaft of the prime mover 36 and the two rotation shafts 40*a*, 40*b*. Control of the number of rotation of the two rotation shafts 40*a*, 40*b* by changing a diameter etc. of the pulley 37, together with control of rotation of the prime mover 36, allows control of the frequency of oscillation in the reciprocating motions of the oscillating plates 42*a*, 42*b* (that is, oscillation of the oscillated products).

Specifications of the rotation shafts are not limited, and diameters or materials thereof are not limited as long as the rotation shafts have predetermined strength. Specifications of the conduction member are not limited, and a timing belt or a gear may be used. The bearing is not limited as long as it supports the rotation shaft that performs the rotational motion.

The rotation shafts 40*a*, 40*b* have the cranks 38, 39, respectively, and the cranks 38, 39 face diametrically opposite directions as shown in FIGS. 12 and 13. The oscillating plates 42*a*, 42*b* are placed substantially symmetrically with respect to the two rotation shafts 40*a*, 40*b*, the oscillating plate 42*a* is connected to the crank 38 of the rotation shaft 40*a* via the rod 41*a*, and the oscillating plate 42*b* is connected to the crank 39 via the rod 41*b*.

The oscillating plates 42*a*, 42*b* on which the oscillated products 44*a*, 44*b* are placed and fixed are versatile flat plates, and are movably mounted to the two linear bearings 43*a*, 43*b*, respectively. The linear bearing is one of the slide guide mechanisms, and a bearing using a ball or a roller for guiding the oscillated product that performs a linear motion.

As the slide guide mechanism, besides the linear bearing, a ball spline bearing for endless sliding, an oilless bearing, etc. can be used. Detailed specifications thereof, and an aspect of mounting the oscillating plate to the slide guide mechanism are not limited as long as a high speed reciprocating motion can be realized, and the oscillating plate is hard to release in the reciprocating motion. The shape etc. of the oscillating plate is not limited as long as it can fix the oscillated product, and if the oscillated product has a specific shape, the oscillated product may be fixed via a mounting jig.

According to such aspects of the cranks 38, 39, the rotational motion caused by the prime mover 36 is converted into two reciprocating motions in substantially horizontal opposite directions of the oscillating plates 42*a*, 42*b* connected to the cranks 38, 39 and distributed. Then, the oscillated product 44*a* fixed on the oscillating plate 42*a* and the oscillated product 44*b* fixed on the oscillating plate 42*b* are oscillated at the same time in horizontal opposite directions to cancel vibration each other.

Figure 15:
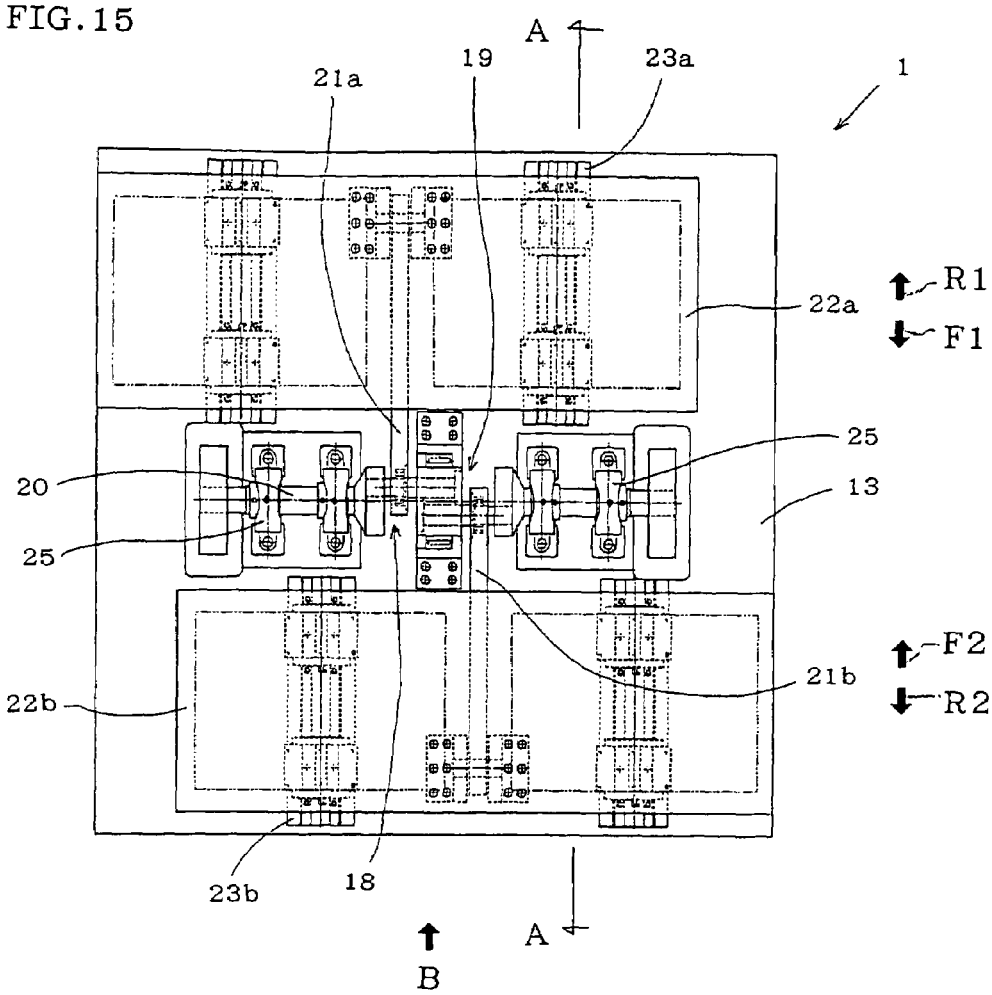
FIG. 15 is a top view of another embodiment of an oscillating apparatus according to the present invention.
Figure 16:
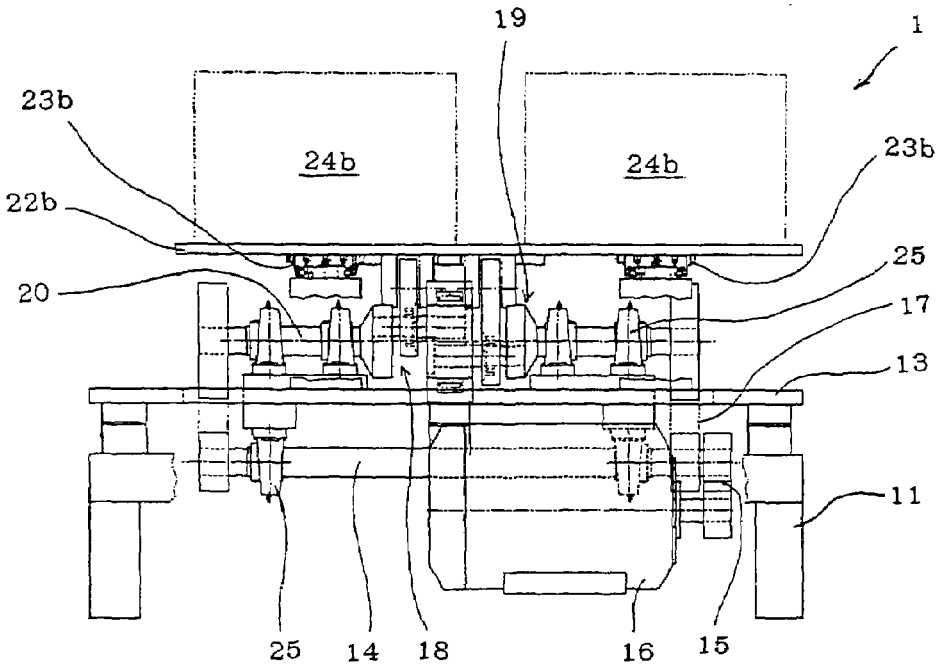
FIG. 16 is a view, partially in perspective, of the oscillating apparatus taken in the direction of arrow B in FIG. 15.
Figure 17:
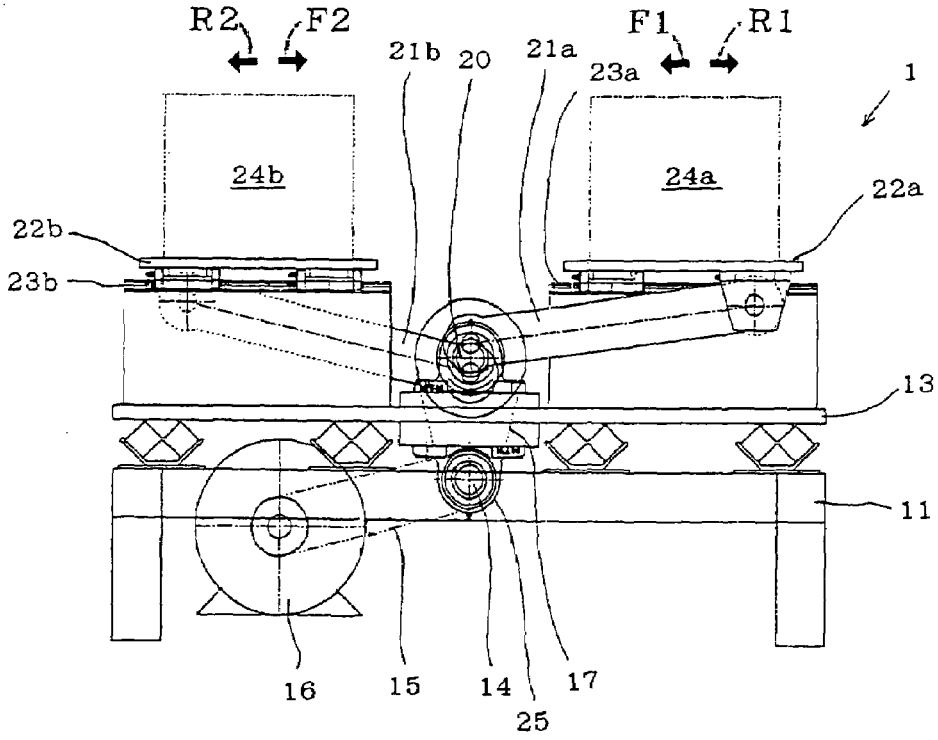
FIG. 17 is a sectional view of the oscillating apparatus taken along the line A—A of FIG. 15.

FIG. 15 is a top view of another embodiment of an oscillating apparatus according to the present invention, FIG. 16 is a view (side view), partially in perspective, taken in the direction of arrow B in FIG. 15, and FIG. 17 is a sectional view (side view) taken along the line A—A of FIG. 15.

In an oscillating apparatus 1 as shown, power for oscillation is provided by a prime mover 16. A rotational motion caused by the prime mover 16 is transmitted to a primary rotation shaft 14 by a primary conduction member 15 to rotate the primary rotation shaft 14. Then, the rotational motion is transmitted to a secondary rotation shaft 20 by a secondary conduction member 17 to rotate the secondary rotation shaft 20. The secondary rotation shaft 20 rotates, but the rotational motion thereof is converted into two opposite reciprocating motions by two cranks 18, 19 provided on the secondary rotation shaft 20. Specifically, an oscillating plate 22*a* connected to the crank 18 via a rod 21*a* performs a reciprocating motion along a linear bearing 23*a* that is one of slide guide mechanisms, an oscillating plate 22*b* connected to the crank 19 via a rod 21*b* performs a reciprocating motion along a linear bearing 23*b* that is one of slide guide mechanisms, and the reciprocating motions are performed such that when the oscillating plate 22*a* moves in a direction F1, the oscillation plate 22*b* moves in a direction F2, and when the oscillating plate 22*a* moves in a direction R1, the oscillation plate 22*b* moves in a direction R2. In other words, the oscillating plates 22*a*, 22*b* perform reciprocating motions in opposite directions symmetrically with respect to the secondary rotation shaft 20 as their symmetrical axis.

The reciprocating motions cause, at the same time, oscillation of an oscillated product 24*a* and an oscillated product 24*b* fixed on the oscillating plate 22*a* and the oscillating plate 22*b*, respectively, and vibration caused by the reciprocating motion of the oscillating plate 22*a* and the oscillation of the oscillated product 24*a* and vibration caused by the reciprocating motion of the oscillating plate 22*b* and the oscillation of the oscillated product 24*b* cancel each other. Thus, the operational environments are improved to reduce influences on the environments around the plant.

In the oscillating apparatus 1, a bed plate 13 is placed on a bed 11, and all components other than the prime mover 16 are mounted to the bed 11. The prime mover 16 may be provided on a vibration insulating bed. The shown prime mover 16 is an electric motor, but not limited to the electric motor, the prime mover may be an internal combustion engine etc. in the present invention.

The primary rotation shaft 14 is rotatably mounted to an underside of the bed plate 13 by a bearing 25, and the primary rotation shaft 14 is connected to a rotation shaft of the prime mover 16 via the primary conduction means 15. Further, the secondary rotation shaft 20 is rotatably mounted to a top side of the bed plate 13 by the bearing 25, and the secondary rotation shaft 20 is connected to the primary rotation shaft 14 via the secondary conduction member 17.

The primary conduction member 15 and the secondary conduction member 17 are timing belts (toothed conduction belts), and mesh gears provided on the rotation shaft of the prime mover 16, the primary rotation shaft 14, and the secondary rotation shaft 20 to transmit the rotational motions. Changing the gear ratio, together with control of rotation of the prime mover 16, allows control of the frequency of oscillation in the reciprocating motions of the oscillating plates 22*a*, 22*b* (that is, oscillation of the oscillated products) through control of the number of rotation of the secondary rotation shaft 20.

Specifications of the primary rotation shaft and the secondary rotation shaft are not limited, and diameters or materials thereof are not limited as long as the rotation shafts have predetermined strength. Specifications of the primary conduction member and the secondary conduction member are not limited, and a V belt or a gear may be used. The primary conduction member and the secondary conduction member do not need to have the same specifications. The bearing is not limited as long as it supports the rotation shaft that performs the rotational motion.

The secondary rotation shaft 20 has the two cranks 18, 19, and the cranks 18, 19 face diametrically opposite directions as shown in FIGS. 15 and 16. In other words, the two cranks 18, 19 facing opposite directions are placed on a plane passing an axis of the secondary rotation shaft 20. The oscillating plate 22*a* and the oscillating plate 22*b* are placed substantially symmetrically with respect to the secondary rotation shaft 20, the oscillating plate 22*a* is connected to the crank 18 of the secondary rotation shaft 20 via the rod 21*a*, and the oscillating plate 22*b* is connected to the crank 19 via the rod 21*b*.

The oscillating plates 22*a*, 22*b* on which the oscillated products 24*a*, 24*b* are placed and fixed are versatile flat plates, and are movably mounted to the two linear bearings 23*a*, 23*b*, respectively.

Detailed specifications of the slide guide mechanism, and an aspect of mounting the oscillating plate to the slide guide mechanism are not limited as long as a high speed reciprocating motion can be realized, and the oscillating plate is hard to release in the reciprocating motion. The shape etc. of the oscillating plate is not limited as long as it can fix the oscillated product, and if the oscillated product has a specific shape, the oscillated product may be fixed via a mounting jig.

According to such aspects of the cranks 18, 19, the rotational motion caused by the prime mover 16 is converted into two reciprocating motions in substantially horizontal opposite directions of the secondary rotation shift 20 of the oscillating plates 22*a*, 22*b* connected to the cranks 18, 19. Then, the two oscillated products 24*a* fixed on the oscillating plate 22*a* and the two oscillated products 24*b* fixed on the oscillating plate 22*b* are oscillated at the same time in horizontal opposite directions to cancel vibration each other.

The oscillating apparatus according to the present invention is means for efficiently oscillating a work etc. while restraining vibration or dust, and does not limit specific use of what to oscillate, or advantages of the oscillation etc. Now, use and advantages provided by the oscillating device according to the present invention will be exemplified.

In the oscillating apparatus according to the present invention, a mixture of a work etc. with a burr, flash, scale, etc. and an abrasive or a grinding assistant is used as an oscillated product, and the mixture is put in a container and oscillated to smooth and clean a surface of the work. It is considered that the oscillation causes repeated collisions of the abrasive or the grinding assistant with the work to grind the surface of the work.

The oscillating apparatus according to the present invention provides advantages similar to those of the vibration generating apparatus in Patent document 8 by different means. For example, a hollow casting, in which metal containing a polyhedral or spherical material is put in a hollow portion to close the hollow portion, is used as an oscillated product, and oscillating the product allows removal of powdery and particulate matters remaining on a surface of a wall portion defining the hollow portion. It is considered that, the oscillation causes repeated collisions of the metal containing at least the polyhedral or spherical material with the wall portion defining the hollow portion to causes the shock, which causes the powdery and particulate matters to leave the casting surface, and to be removed.

Further, the oscillating apparatus according to the present invention is suitable for the case where the oscillated product is a mixture of a hollow product and a surface treated material. The hollow product means a treated product including a hollow casting and having a hollow portion, and the treated product means an object that is to be subjected or has been subjected to predetermined treatment. For example, a hollow product in which a surface treatment material containing a polyhedral or spherical material is put in a hollow portion to close the hollow portion is uses as an oscillated product, and oscillating the product allows a surface of a wall forming the hollow portion to be subjected to predetermined treatment. The predetermined treatment is, for example, forming dimples on the surface of the wall portion, though not limited. The hollow portion with dimples reduces resistance when a fluid passes, and the hollow product subjected to such treatment is suitable for machine members that treat a fluid such as gas or liquid. Specifically, as the hollow product, any one casting selected from an automotive air intake system parts group consisting of an intake manifold, turbine housing, compressor cover, cylinder head, and air duct can be cited. These are hollow castings, therefore it is preferable that the surface treatment material contains at least the polyhedral or spherical material as described above, and made of at least a metal material.

In the case of the oscillating apparatus according to the present invention, there is no limitation in oscillating conditions, but for example, when a mixture of the treated product and the abrasive is oscillated to grind the oscillated product, or when a mixture of the treated product and the surface treatment material is oscillated to form dimples, a frequency of oscillation is preferably about 3 to 30 Hz, a stroke (amplitude) of the oscillation is preferably about 10 to 500 mm, and total oscillation time is preferably about 3 to 180 minutes. It is preferable that, for the oscillating apparatus according to the present invention, materials of the components are selected and mechanical strength is determined, so as to provide appropriate specifications according to the above described values.

EXAMPLES

Next, the present invention will be described in further detail with reference to examples. The present invention is not limited to these examples.

As surface treated products, four intake manifolds for a six-cylinder V engine, which are hollow castings, were prepared by being molded by a casting process with using an aluminum alloy as a raw material.

Example 1

Figure 5:
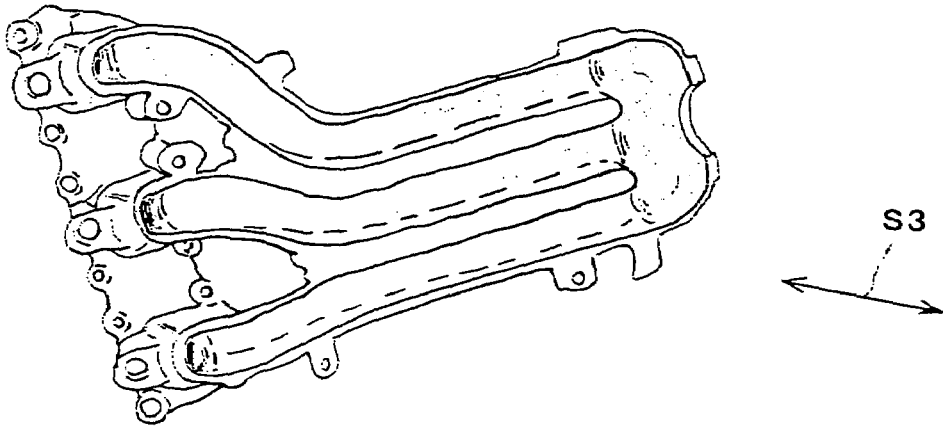
FIG. 5 is a view in which the surface treated product used in Example is cut by a horizontal plane, and a hollow portion is exposed.

Shocks were applied to the molded intake manifold by oscillation to collapse and remove the core. Thereafter, 41 steel balls having a diameter of 10 mm and 3 steel balls having a diameter of 20 mm were put in the hollow portion, which is a gas supply pipe, as surface treatment materials, and the intake manifold was oscillated for 100 minutes, at an oscillation frequency of 8 Hz, at a stroke of 60 mm to treat the hollow portion. The result is given in Table 1. The shape of the intake manifold is shown in FIG. 5 (FIG. 5 is a view in which the hollow portion is cut and exposed). Also, the oscillating direction was the direction indicated by the arrow mark S3 in FIG. 5.

Comparative Example 1

The treatment of the hollow portion was performed by the same method as that in Example 1 except that stainless steel shot balls having a diameter of 0.6 mm were used as a surface treatment material and the oscillation time was 120 minutes. The result is given in Table 1.

Comparative Example 2

The treatment of the hollow portion was performed by the same method as that in Example 1 except that silica sand of horning sand was used as a surface treatment material and the oscillation time was 120 minutes. The result is given in Table 1.

Comparative Example 3

The treatment of the hollow portion was performed by the same method as that in Example 1 except that grindstone chips were used as a surface treatment material and the oscillation time was 120 minutes. The result is given in Table 1.

TABLE 1

| | Frequency [Hz] | Oscillation amplitude [mm] | Surface treating material | Oscillation time [min] | Surface roughness Ra [μm] |
|---|---|---|---|---|---|
| Example 1 | 8 | 60 | Steel balls 10 mm in dia × 41<br>Steel balls 20 mm in dia × 3 | 100 | 2.00 |
| Comparative example 1 | 8 | 60 | SUS shot balls (0.6 mm in dia) | 120 | 6.90 |
| Comparative example 2 | 8 | 60 | Horning sand (silica sand) | 120 | 9.48 |
| Comparative example 3 | 8 | 60 | Grindstone chips | 120 | 7.04 |

INDUSTRIAL APPLICABILITY

As described above, according to the present invention, there is provided the surface treated product that moves relatively in the fluid and has the feature on its surface. There are further provided the surface treatment method and the surface treatment apparatus that allow such a surface treated product to be obtained. The surface treated product according to the present invention improves the flow state when the fluid flows on the surface, and reduces the resistance of the fluid. As a hollow casting that is the surface treated product according to the present invention, an automotive air intake system part such as an intake manifold can be manufactured, and by providing this automotive air intake system part, the output of an engine can be increased.

According to the manufacturing method of a hollow casting of the present invention, a core can be removed while smoothing without using the conventional means such as horning, and a hollow casting can be obtained that has a smooth surface of a wall portion defining a hollow portion without using a core whose surface is especially smoothed. Therefore, the core can be manufactured at a lower cost, and a problem of the production of burrs etc. ascribed to the core is less liable to arise. Also, the equipment cost and operation cost for horning etc. can be reduced, and the manufacturing process can be shortened. Further, the smoothing material can be used repeatedly. Since the change interval of a cutting oil and a cutter blade is lengthened in the subsequent process, the production of wastes can be restrained. In addition, the present invention can contribute to the reduction in environmental load through these advantages.

According to the sand removing method of a hollow casting of the invention, core sand can be easily and sufficiently removed from a surface of a hollow casting, even if the hollow casting has a simple shape or a complex shape with a bent hollow portion, and a clean hollow casting with the core sand removed from the surface can be obtained.

Further, according to the oscillating apparatus of the present invention, castings or other works can be efficiently oscillated while restraining vibration thereof and of the oscillating apparatus. Application to grinding, dimple forming, or other surface treatment, removal of core sand, and removal of other unnecessary residual matters, with respect to the castings or other works, contributes to improved competitiveness of castings or other works subjected to the treatment.

The invention claimed is:

1. A hollow casting, in which continuous dimples, each of which has a diameter of 10 to 2500 μm and a depth of 50 μm or less are formed on an internal surface of the hollow casting, the entire continuous dimples and their edges being formed to be smooth.

2. The hollow casting according to claim 1, wherein the dimples are of an indefinite shape.

3. The hollow casting according to claim 1, wherein the hollow casting is made of cast iron or a light alloy for casting as a principal material.

4. The hollow casting according to claim 1, wherein the hollow casting is any one part selected from an automotive air intake system parts group consisting of an intake manifold, a turbine housing, a compressor cover, a cylinder head, and an air duct.

5. A hollow casting according to claim 1, wherein the hollow casting internal surface has a surface roughness Ra of 10 μm or less.

6. The hollow casting according to claim 1, wherein the hollow casting has a bend.

7. A method for treating an internal surface of a hollow casting, the method comprising the steps of placing a surface treatment material containing at least a polyhedral or spherical material having a diameter of 5 mm or more inside a hollow casting, subsequently colliding the surface treatment material with the internal surface to cause the surface treatment material to form continuous dimples, each of which has a diameter of 10 to 2500 μm and a depth of 50 μm or less on the internal surface of the hollow casting.

8. The surface treatment method according to claim 7, wherein said surface treatment material is made of two or more types of materials.

9. The surface treatment method according to claim 7, wherein said collision is caused by oscillation of either or both of said hollow casting and said surface treatment material.

10. The surface treatment method according to claim 7, wherein a percentage by volume of said surface treatment material put in said hollow portion to said hollow portion is about 5% to 70%.

11. The surface treatment method according to claim 9, wherein a stroke of said oscillation is about 30 to 200 mm.

12. The surface treatment method according to claim 9, wherein total oscillation time of said oscillation is about 3 to 120 minutes.

13. The surface treatment method according to claim 7, wherein a principal material forming said hollow casting is cast iron or a light alloy for casting.

14. The surface treatment method according to claim 13, wherein at least a part of said surface treatment material is made of a metal material.

15. The surface treatment method according to claim 7, wherein the hollow casting has a bend.

16. The surface treatment method according to claim 9, wherein the oscillation is carried out at an oscillation frequency of 5 to 20 Hz.

* * * * *